US008322037B2

(12) United States Patent
Carlson et al.

(10) Patent No.: US 8,322,037 B2
(45) **Date of Patent: *Dec. 4, 2012**

(54) METHOD OF FORMING LIGHTWEIGHT STRUCTURAL BUILDING ELEMENT

(75) Inventors: Barry Carlson, Windsor, CO (US); Jason Underhill, Fort Collins, CO (US)

(73) Assignee: TAC Technologies, LLC, Fort Collins, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/015,191

(22) Filed: Jan. 27, 2011

(65) Prior Publication Data

US 2011/0179647 A1 Jul. 28, 2011

Related U.S. Application Data

(63) Continuation of application No. 11/696,629, filed on Apr. 4, 2007, now Pat. No. 7,882,679, which is a continuation of application No. 11/194,973, filed on Aug. 2, 2005, now Pat. No. 7,213,379.

(60) Provisional application No. 60/598,014, filed on Aug. 2, 2004, provisional application No. 60/644,451, filed on Jan. 14, 2005, provisional application No. 60/686,870, filed on Jun. 1, 2005.

(51) Int. Cl.
*B21D 47/00* (2006.01)
*E04C 3/00* (2006.01)

(52) U.S. Cl. ..... 29/897.3; 29/897.31; 29/527.2; 52/834

(58) Field of Classification Search ..... 29/897.31, 29/897.312, 897.33, 897.34, 897.35, 527.1, 29/527.2, 557; 264/209.1, 464; 52/834, 52/836, 851

See application file for complete search history.

(56) References Cited

U.S. PATENT DOCUMENTS

| | | | | |
|---|---|---|---|---|
| 526,730 | A | 10/1894 | Norcross | |
| 910,192 | A * | 1/1909 | Grouvelle et al. | 138/38 |
| 1,422,579 | A | 7/1922 | Kent | |
| 2,751,775 | A | 6/1956 | Sergovic | |
| 3,228,162 | A | 1/1966 | Gregoire | |
| 3,239,982 | A | 3/1966 | Nicosia | |
| 3,307,312 | A | 3/1967 | Kriebaum | |

(Continued)

FOREIGN PATENT DOCUMENTS

DE 1484185 2/1969

(Continued)

OTHER PUBLICATIONS

Non-final Office Action, mailed Apr. 29, 2009, in U.S. Appl. No. 11/777,930, filed Jul. 13, 2007, by Barry Carlson, et al.

(Continued)

*Primary Examiner* — Alexander P Taousakis
(74) *Attorney, Agent, or Firm* — William W. Cochran; Cochran Freund & Young LLC

(57) ABSTRACT

A system and method of manufacture providing reinforced structurally functional load-bearing members, including but not limited to using thermoplastic materials, such as High Density Polyethylene (HDPE), reinforced such as with an aluminum alloy or carbon fiber core element. Among its possible uses, the present invention has application for provision of structural support members, such as an illustrative I-joist product having a vertical center member preferably comprising HDPE, and top and bottom flanges having structurally meaningful reinforcement. The center member and flanges preferably comprising HDPE provides a relatively hard, durable, substantially weather-resistant structure.

10 Claims, 16 Drawing Sheets

U.S. PATENT DOCUMENTS

| | | | | |
|---|---|---|---|---|
| 3,507,738 | A | | 4/1970 | Prusinski |
| 3,511,743 | A | | 5/1970 | Rach |
| 3,516,213 | A | | 6/1970 | Sauer |
| 3,617,364 | A | | 11/1971 | Jarema et al. |
| 3,707,401 | A | | 12/1972 | Jarema et al. |
| 3,708,380 | A | | 1/1973 | Niebylski |
| 3,753,326 | A | | 8/1973 | Kaufman |
| 4,019,301 | A | * | 4/1977 | Fox ..... 52/834 |
| 5,036,210 | A | * | 7/1991 | Goodman ..... 235/493 |
| 5,085,722 | A | * | 2/1992 | Sikorski ..... 156/169 |
| 5,511,355 | A | | 4/1996 | Dingler |
| 5,579,618 | A | * | 12/1996 | Riegelman ..... 52/309.16 |
| 5,580,648 | A | * | 12/1996 | Castle et al. ..... 442/21 |
| 6,023,903 | A | | 2/2000 | Stecker |
| 6,112,410 | A | * | 9/2000 | Rastegar ..... 29/897.35 |
| 6,826,884 | B2 | | 12/2004 | Pabedinskas et al. |
| 6,863,972 | B2 | | 3/2005 | Burger et al. |
| 6,955,023 | B2 | | 10/2005 | Rotheroe |
| 7,213,379 | B2 | | 5/2007 | Carlson et al. |
| 7,721,496 | B2 | | 5/2010 | Carlson et al. |
| 7,882,679 | B2 | | 2/2011 | Carlson et al. |
| 7,930,866 | B2 | | 4/2011 | Carlson et al. |
| 2003/0014938 | A1 | | 1/2003 | Deschenes |
| 2004/0031230 | A1 | | 2/2004 | Pabedinskas et al. |

FOREIGN PATENT DOCUMENTS

| | | |
|---|---|---|
| DE | 3045389 | 7/1982 |
| DE | 9206272 | 9/1992 |
| FR | A2760478 | 9/1998 |

OTHER PUBLICATIONS

Non-final Office Action, mailed Nov. 21, 2006, in U.S. Appl. No. 11/194,973, filed Aug. 2, 2005, by Barry Carlson et al.

Non-final Office Action, mailed Mar. 9, 2009, in U.S. Appl. No. 11/696,629, filed Apr. 4, 2007, by Barry Carlson, et al.

Non-final Office Action, mailed Mar. 2, 2010, in U.S. Appl. No. 11/696,629, filed Apr. 4, 2007, by Barry Carlson, et al.

Non-final Office Action, mailed Jun. 25, 2010, in U.S. Appl. No. 11/696,629, filed Apr. 4, 2007, by Barry Carlson, et al.

* cited by examiner

METHOD OF FORMING LIGHTWEIGHT STRUCTURAL BUILDING ELEMENT

CROSS REFERENCE TO RELATED APPLICATIONS

This application is a continuation of U.S. application Ser. No. 11/696,629, filed Apr. 4, 2007, now U.S. Pat. No. 7,882,679 which application is a continuation of U.S. application Ser. No. 11/194,973, filed Aug. 2, 2005, now U.S. Pat. No. 7,213,379 which claims the benefit of U.S. Provisional Application No. 60/598,014 filed on Aug. 2, 2004, U.S. Provisional Application No. 60/644,451 filed on Jan. 14, 2005, and U.S. Provisional Application No. 60/686,870 filed on Jun. 1, 2005, the entire disclosures of which are incorporated herein by reference in their entirety for all they disclose and teach.

FIELD OF THE INVENTION

The present invention is directed to construction materials, and more particularly, to structural members, such as joists, posts and beams, as well as methods of manufacturing the same.

BACKGROUND OF THE INVENTION

Use of engineered materials, such as wood composites and various plastics, including recyclable thermoplastic, such as high-density polyethylene (HDPE), is becoming increasingly popular in the construction industry. These uses encompass various horizontal and vertical applications that meet a range of present decorative and/or structural construction needs.

Structural members, such as joists, beams and the like, are currently available as wood lumber, a valuable yet limited resource with no recycling capability, as plastic lumber, and as reinforced or composite lumber. Composites often include wood fiber or fiberglass in a plastic matrix, or wood composites such as I-joist products having oriented strand board with micro-laminated top and bottom flanges.

Wood-containing products generally are sensitive to environmental conditions, such as the effect of moisture. Such sensitivity must be accounted for during design, installation and use. There are various recyclable thermoplastic products available which are generally less sensitive to environmental conditions, specifically to the effect of moisture, than wood and composite products. Design benefits follow accordingly.

HDPE resins are used in a variety of blow molding, rotational molding, and extruded applications for liquid food containers, automotive fuel tanks, and large volume drums. HDPE is widely known as the material of choice for recyclable milk containers. It is also widely used for pipelines for water or other solution distribution systems, and for liners for landfills, water, or other solution holding ponds.

U.S. Plastic Lumber Corporation provides a fiberglass reinforced HDPE product that is available in sizes and shapes of standard lumber. These plastic lumber products are typically heavy and contain fiberglass fibers that can quickly dull saw blades and drill bits of construction equipment used to size the materials. Other known HDPE I-joists contain hollow cores with wide flanges that are not conducive to easy cutting-to-dimension with standard construction tools, nor fit with standard fasteners.

Accordingly, there is a need for structural members, including joists, beams, posts and the like, that are preferably made of a weather-resistant recyclable material and that provide adequate structural performance while not being too heavy or large for practical use. In addition, there is a need for providing reinforced structural members that provide adequate structural performance and that can be worked with standard construction equipment without unduly dulling cutting blades and drill bits. There is a further need for such members to be available in either standard and custom sizes and ratings, on demand or as needed, and with the possibility of working the engineering tradeoff between strength and weight in use of engineered materials, such as HDPE.

SUMMARY OF THE INVENTION

One aspect of the present invention relates to load-bearing systems, and methods of manufacture, that provide structurally functional, load-bearing assemblies. Embodiments of the invention include, but are not limited to, thermoplastic structural materials such as HDPE in a form that is reinforced with a rigidifying portion, such as an aluminum, aluminum alloy, or carbon fiber core.

More specifically, novel structural members may include various joists, beams, posts and the like, having sufficient strength and deflection characteristics for use in structural applications, such as framing, for decking and the like. Such structural members are comparatively lighter in weight as compared to currently available fiber-reinforced plastic lumber products and are more weather-resistant compared to wood and wood-composite products.

An illustrative I-joist product in one aspect of the present invention defines a vertical center member preferably including HDPE, and top and bottom flanges interconnected to the vertical center member, also including HDPE. The HDPE provides a relatively hard, durable, substantially weather-resistant structure. The flanges form a system having structural vigor and enable the HDPE-based system to provide sufficient strength, construction flexibility, and true alignment (i.e., true to specification).

In accordance with other embodiments of the present invention, such I-joists are provided that adequately support loads for indoor and/or outdoor decking, flooring, and other support systems. Webbing may be formed with or as a rigid member and may be combined with top and bottom flanges of a relatively hard, durable, flexible, and substantially weather-proof material. Preferred materials include either virgin and/or recycled HDPE, surrounding a suitable rigidizing core component, such as of an aluminum alloy. Use of recyclable material, such as HDPE, enables cut waste to be recycled. This recycling meets and adheres to current "Green Build" objectives, and is environmentally proactive. Therefore, the present invention not only achieves the design criteria required for support, but also provides a framework suitable for re-use of components in the future.

In various embodiments, webbing and top and bottom flanges of I-joists are manufactured with various dimensions and characteristics and with various materials to achieve maximum transfer of loading with minimal to no vertical or horizontal movement of the finished joist, as specified, while standard construction tools can be used to cut the product to desired dimensions.

Preferably, the load-bearing members, for example, the top and bottom flanges of an I-joist, contain a strengthening core material or other channel or flange reinforcing members so as to stabilize the member and to assist in load-bearing. Thus, depending on load requirements, either or both the top and/or bottom flanges of an I-joist of the invention may contain one or more of various reinforcing members, which may include aluminum or other alloys, or other materials such as carbon fiber, and may include rods, C- and/or M-shaped channels, channels with center slot, or other configurations, for supplying a desired structural reinforcement.

Load-bearing HDPE embodiments of the present invention weather exceptionally well and do not absorb moisture. Therefore the present invention may be freely utilized for both indoor and outdoor support structures.

In various embodiments, vertical and/or horizontal support members of the invention may replace wood and/or composite material members, and may have hollow or solid cores depending upon the application and need, while also being configurable in custom and/or standard sizes. For example, boards, studs, posts and beams can be provided as standard 2.times.4, 4.times.4, 6.times.6 (values in inches) sized lumber, and joists, rim joists, and beams can be provided as standard 2.times.8, 2.times.10, 2.times.12 sized lumber, while engineered I-joists can be provided as standard sized 9½ or 11⅞ members with 2 1/16 flanges. It is advantageous that such standard sizes will enable use of conventional fasteners and other hanging hardware.

In several embodiments of the invention, structural members are configured to meet given design specifications, which may be custom or customary specifications. Structural configuration and use may be anticipated accordingly during the manufacture process, or can be adjusted before installation by selection or by adding strengthening components.

Joists according to the invention therefore may be supplied having specifications that enable center-to-center spacing selected according to project needs and design specifications while still providing substantially straight and true structural framing. These structural members can be delivered to specification without the need for trimming and truing as per wood lumber, and with minimal cutting but for length adjustments, if needed. This flexibility and reliability is uncommon to lumber products.

Another aspect of the present invention may also include an extrusion process for extruding load members, and further provides a dual extrusion process wherein a reinforcing member, such as an aluminum alloy, is extruded with a specified shape, cooled, prepared for receipt of the HPDE, and the HDPE is then extruded around the reinforcing member, with an option of also within the reinforcing member, and then cooled, all within a continuous process, to form a structural assembly or member of the invention.

In certain embodiments of the invention, the extruded aluminum, other alloy component, or carbon fiber reinforcing member may comprise an outer surface that includes a configuration for enhanced bonding between itself and the HDPE. This may include scarification of the surface, apertures in the surface, application of bonding tape, provision of ribs or other non-flat surface features, or the like, to provide a bonding and adhesion surface for the HDPE. Improved bonding between the aluminum and HDPE can improve the load bearing rating of the final product.

For at least one embodiment of the present invention having a reinforcing member with a plurality of arms, the reinforcing member is shaped such that with embedding of the reinforcing member, the reinforcing member can produce a mechanical bond with the HDPE or other surrounding material. The reinforcing member may comprise apertures or ribbing to aid in developing a sufficient mechanical bond between the HDPE and the reinforcing member, thereby removing the need for adhesive bonding or scarification of the reinforcing member, although adhesive bonding of the reinforcing member to the HDPE, and/or scarification of the surface of the reinforcing member are also optional.

The extrusion process can be enabled to provide various lengths of product as desired, thereby maximizing shipping efficiency. Typically, 60 foot lengths would optimally fill a rail car load, while 40 foot lengths would be desired for a trailer truck load.

Thus, in accordance with various embodiments of the present invention, a structural joist adapted for use in a building structure is provided, the joist comprising a substantially solid vertical center member comprising a thermoplastic material and having a longitudinal axis, and a top flange and a bottom flange interconnected to said vertical center member and extending substantially the entire length of the longitudinal axis, the top flange and the bottom flange comprising a thermoplastic material. In addition, the joist comprises an outer top flange interconnected to the top flange and extending substantially an entire length of the longitudinal axis, and an outer bottom flange interconnected to the bottom flange and extending substantially the entire length of the longitudinal axis. In addition, the joist comprises a metallic non-planar channel member operatively associated with at least one of the top flange, the bottom flange, the outer top flange, or the outer bottom flange, the channel member extending substantially the entire length of the longitudinal axis.

Further embodiments of the present invention also include a joist with outer flanges, with an optional channel member. Thus, in accordance with embodiments of the present invention, an I-joist adapted for use in a building structure is provide, the I-joist comprising an intermediate member having a longitudinal axis and a top flange and a bottom flange, an outer top flange interconnected to the top flange and extending substantially an entire length of the longitudinal axis, and an outer bottom flange interconnected to the bottom flange and extending substantially the entire length of the longitudinal axis.

At least one method of manufacturing a joist having outer flanges is provided herein, the method of manufacturing a joist comprising providing a vertical center member having a top flange and a bottom flange, providing an outer top flange have a receptacle for receiving the top flange, providing an outer bottom flange have a receptacle for receiving the bottom flange, positioning the top flange in the receptacle of outer top flange, and positioning the bottom flange in the receptacle of outer bottom flange. A reinforcing channel member may also be added as part of the method of manufacturing.

Various embodiments of the present invention may also include joists without outer flanges. Thus, in accordance with embodiments of the present invention, a structural joist is provided comprising a vertical center member, a top flange and a bottom flange connected to the vertical center member, and a reinforcing member substantially embedded within at least one of the top flange and the bottom flange, the reinforcing member extending along substantially an entire length of a longitudinal axis of the at least one of the top flange and the bottom flange, wherein a strength of the structural joist is increased.

Other embodiments of the present invention may include a reinforcing member used in various structures, such as post and joists, wherein the reinforcing member includes a plurality of arms. Thus in accordance with embodiments of the present invention, a structural member is provided, the member comprising a thermoplastic outer member having a longitudinal length; and at least one reinforcing member located within the thermoplastic outer member and extending substantially along the longitudinal length of the thermoplastic outer member, the reinforcing member comprising a plurality of arms.

Another embodiment of the present invention may also include an I-joist, wherein the I-joist comprises a webbing having a longitudinal length, with a top flange connected proximate a first end of the webbing and a bottom flange connected proximate a second end of the webbing, and wherein the top and bottom flanges extend along the longitudinal length. In addition, the I-joist includes at least one reinforcing member located within at least one of the top flange and the bottom flange, the reinforcing member extending substantially along the longitudinal length, and the reinforcing member comprising a plurality of arms.

Among other embodiments of the present invention described herein, an additional method of manufacture is provided for manufacturing a structural support member having a rated deflection loading. The method comprises preparing a structural reinforcing member of at least length L for bonded integration into a structural support member of at least length L, and forming a structural support member preform by feeding the structural reinforcing member into a thermoplastic extruder and extruding the structural reinforcing member with a thermoplastic, wherein the thermoplastic is bonded to the surface of the structural reinforcing member along the length of at least L. In addition, the method comprises controlled cooling of the extrusion-formed structural support member preform wherein the thermoplastic is bonded to the structural reinforcing member along the length of at least L and wherein the bonded thermoplastic and structural reinforcing member share the loading of the structural support member without separating along the at least length L when the structural support member is loaded to the rated deflection loading.

Various embodiments of the present invention are set forth in the attached figures and in the detailed description of the invention as provided herein and as embodied by the claims. It should be understood, however, that this Summary Of The Invention may not contain all of the aspects and embodiments of the present invention, is not meant to be limiting or restrictive in any manner, and that Invention as disclosed herein is and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

Various advantages and benefits of the present invention will be better understood when considered in conjunction with the following detailed description, making reference to the drawings that are not necessarily to scale, wherein:

FIG. 8 is a perspective view of flange reinforcing members of the I-joist depicted in FIG. 7;

FIGS. 9-11A are perspective views of I-joists in accordance with embodiments of the present invention;

DETAILED DESCRIPTION

Figure 1:
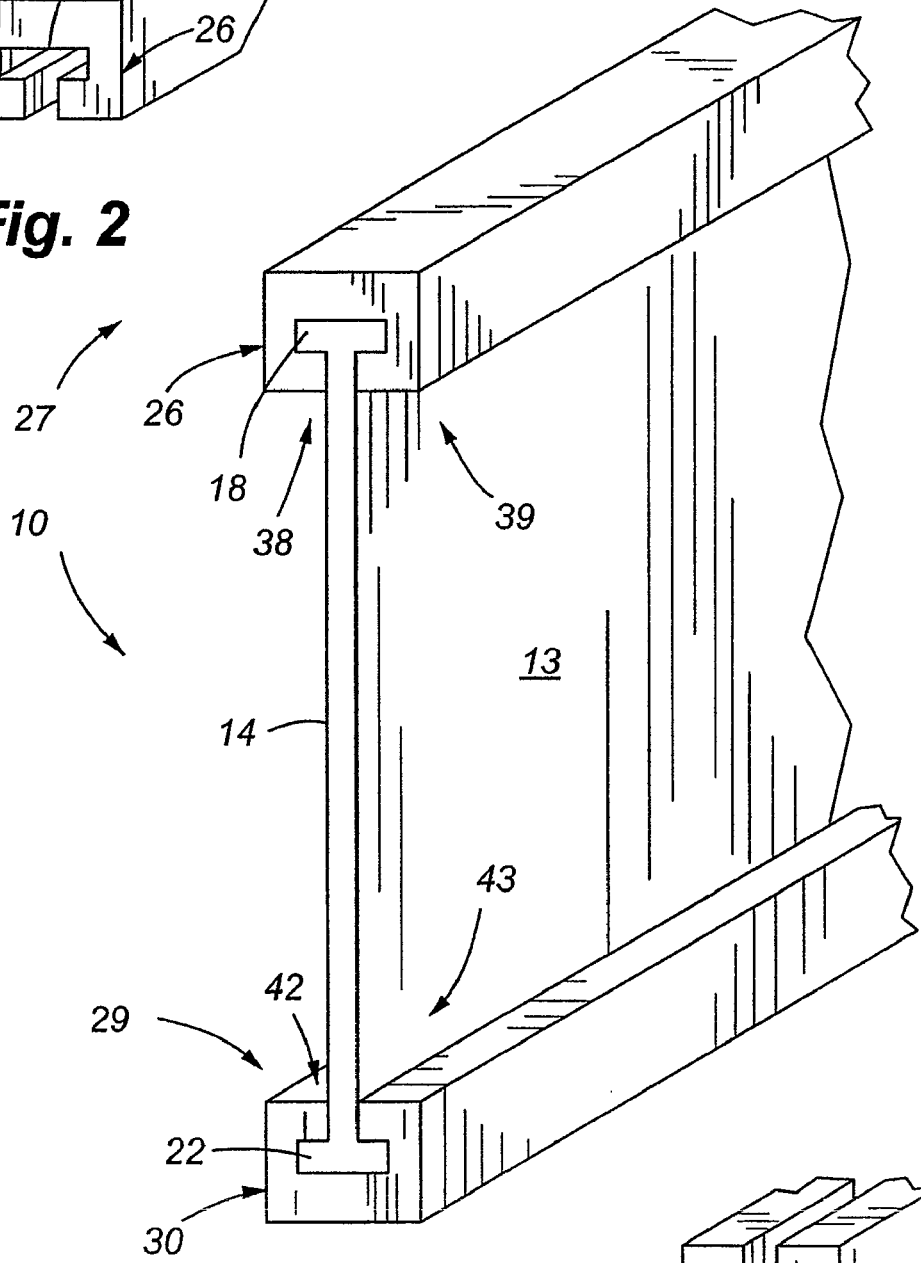
FIG. 1 is a perspective view of an illustrative I-joist in accordance with embodiments of the present invention.

Referring now to FIG. 1, in accordance with embodiments of the present invention, an illustrative I-joist structural member 10 is shown. I-joist 10 includes a web member 13. Web member 13 has a central web or webbing 14, an upper flange 18, and a lower flange 22, wherein flanges 18, 22 are interconnected by webbing 14.

As part of a typical I-joist, webbing 14 interacts as a load-bearing member with load-bearing upper and lower flanges 18, 22. In one embodiment, web member 13 includes webbing 14, upper flange 18 and lower flange 22 formed of a relatively hard, durable, flexible, and substantially weatherproof material, including but not limited to thermoplastics, such as HDPE, and/or thermoplastic composite materials, such as HDPE with additives such as, for example, natural or man-made fibers or particles of various materials/compositions, including but not limited to wood particles and/or fiberglass strands. Preferably web member 13 is extruded.

I-joist 10 also includes an upper outer flange 26 that is interconnected to upper flange 18 to form upper flange assembly 27 and a lower outer flange 30 that is interconnected to lower flange 22 to from lower flange assembly 29. Provision of these flange assemblies 27, 29 increases the rigidity and load-bearing capability of joist 10.

Typically, upper flange 18 and lower flange 22 are similar in cross-section but they may be dissimilar according to design specifications as needed. Likewise, typically outer upper flange 26 and outer lower flange 30 are similar in cross-section but they may be dissimilar according to design specifications as needed.

Alternatively webbing 14, upper flange 18, and lower flange 22 are not integrally formed and may be separately manufactured and then interconnected. For separately extruded parts, interconnection may be by extrusion welding or the like, thus to form web member 13.

Outer flanges 26 and 30 may be formed over upper flange 18 and lower flange 22, respectively, in an integrated manufacturing process or may be separately formed and then mated (e.g., slid) in place and then interconnected, such as by extrusion welding or the like. One advantage of separate components is that a single supply can be used for both outer flanges for an I-joist with symmetrical cross-section, which may provide some cost savings. Alternatively, each component may be separately specified, to provide specialized configurations, as needed, without having to interrupt regular extrusion production runs. Such flexibility enables meeting various architectural and custom design goals while providing some cost savings.

Figure 2:
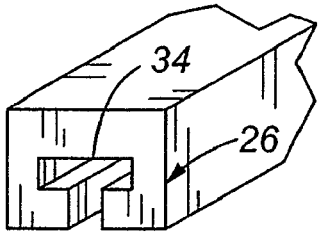
FIG. 2 is a perspective view of an upper outer flange of the I-joist depicted in FIG. 1.
Figure 3:
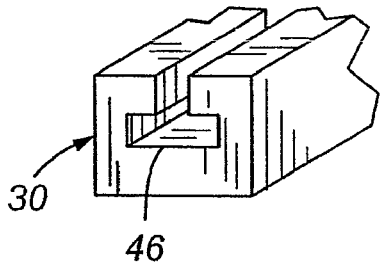
FIG. 3 is a perspective view of a lower outer flange of the I-joist depicted in FIG. 1.

Referring again to FIGS. 1-3, upper flange 18 cooperates with its connection to webbing 14 to form a key 38. More particularly, upper flange 18, as it extends from and in cooperation with webbing 14, forms key 38. Accordingly, upper outer flange 26 includes a receptacle 34 that internally substantially corresponds in shape (i.e., cross section) to the external shape of key 38.

Likewise, lower flange 22 and webbing 14 form a key 42, and lower outer flange 30 includes receptacle 46 that internally substantially corresponds in shape to the external shape of key 42. Receptacle and key pairs 34, 38 and 46, 42, as cooperating locking components, form locking mechanisms 39 and 43, respectively.

Locking mechanism 39 enables flanges 18 and 26 to be intimately mated and structurally sound. Likewise, locking mechanism 43 enables flanges 22 and 30 to be intimately mated and structurally sound.

Outer flanges 26 and 30 preferably feature material characteristics that generally complement the structural characteristics of I-joist 10. In accordance with preferred embodiments of the present invention, outer flanges 26 and 30 include HDPE material.

Webbing 14 is preferably solid, but may be a lattice, slotted or otherwise apertured, depending on the surrounding application environment, needs of the construction project, load-bearing specifications, and overall construction objectives, and may be formed of various suitable load-bearing materials, such as HDPE, aluminum or the like.

Figures 4, 5:
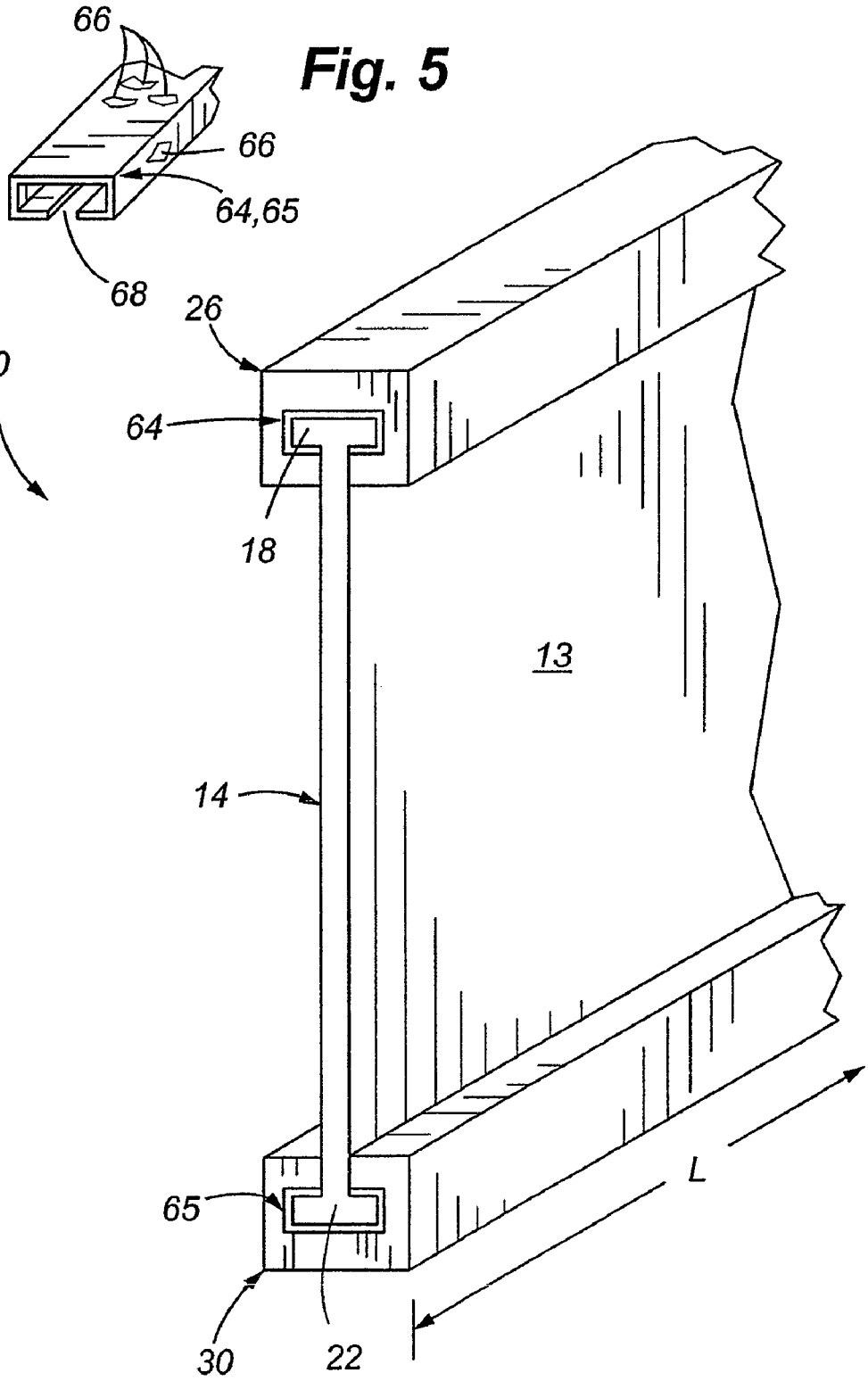
FIG. 4 is a perspective view of an I-joist in accordance with embodiments of the present invention.
FIG. 5 is a perspective view of a channel reinforcing member of the I-joist depicted in FIG. 4.

Referring now to FIGS. 4-5, in accordance with embodiments of the present invention, an I-joist structural member 60 is shown that is similar to I-joist 10 described with respect to FIG. 1, and further includes channel reinforcing members 64, 65.

By way of example and not limitation, channel reinforcing member 64, 65 have a substantially rectangular shape with an opening 68 along one side. The shape of each channel reinforcing member 64, 65 allows it to be engaged or slid over upper flange 18 and lower flange 22, respectively, prior to, or in combination with interconnecting with outer flanges 26 and 30. Preferably, channel reinforcing members 64, 65 include a metal alloy, as for example, an aluminum alloy, with the thickness of the sidewalls of each channel reinforcing member being selected based on intended use and designed loading of I-joist 60. Channel reinforcing members 64, 65 preferably extend substantially the entire longitudinal length L of I-joist 60.

Figure 6:
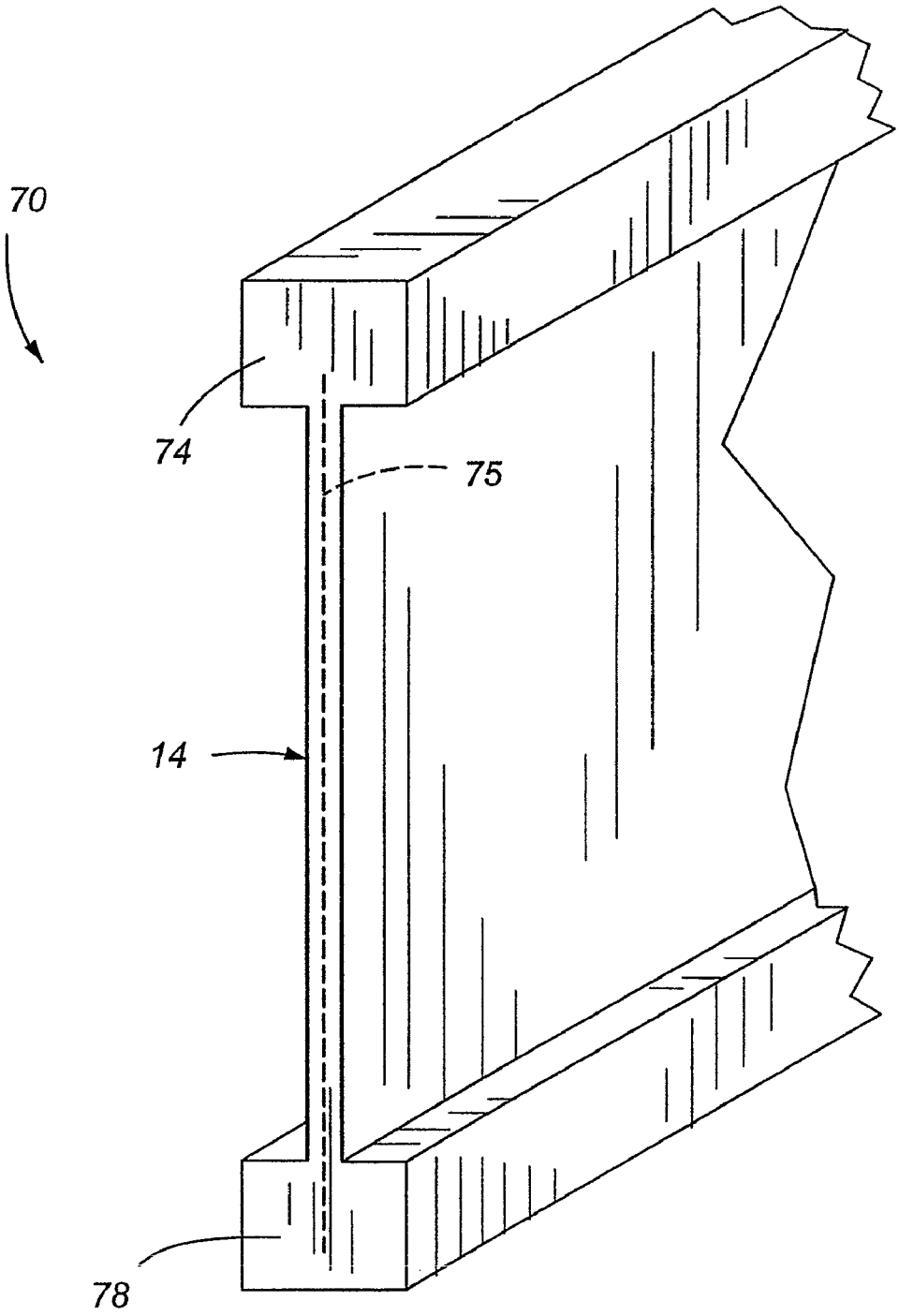
FIG. 6 is a perspective view of an I-joist in accordance with embodiments of the present invention.

Referring now to FIG. 6, an I-joist structural member 70 in accordance with embodiments of the present invention is shown. I-joist 70 includes webbing 14 having an integrated upper flange 74 and lower flange 78, where flanges 74 and 78 have a relatively larger cross-sectional area than flanges 18 and 22 of I-joist 10.

Preferred embodiments of the invention include structural members formed with HDPE and a reinforcing member that acts as a strengthened core for the HDPE. The HDPE is preferably without cellular fiber content, such as wood fiber, and at least to the extent that any such content should not seriously impact resistance to moisture of the resulting structural member. Also preferably, the HDPE is without mineral fiber content, such as fiberglass, to the extent that the ability of the structural member can remain easily cut and/or drilled without tool damage. However, unless otherwise specified, any thermoplastic and/or thermoplastic composite materials are collectively herein referred to as simply "HDPE" or "thermoplastic," and it is to be understood that reference herein to "HDPE" and "thermoplastic" includes other possible thermoplastics other than HDPE, as well as blends, composite/amended thermoplastic materials, and/or coated thermoplastic members, and further includes substantially virgin or recycled HDPE. Furthermore, other materials other than thermoplastics are within the scope of the invention. Thus, a structural member, such as an I-joist, that utilizes a non-thermoplastic (non-HDPE) material to form its flanges and/or webbing, is within the scope of the present invention.

In alternative embodiments of the invention, I-joist 70 is formed with a structure of HDPE, wherein either the webbing 14 and/or any of the flanges, include one or more reinforcing or strengthening members. A strengthening member 75 is indicated by dotted detail in FIG. 6, which may include, as for example, a fiberglass, metal, wood, or composite material.

Figure 7:
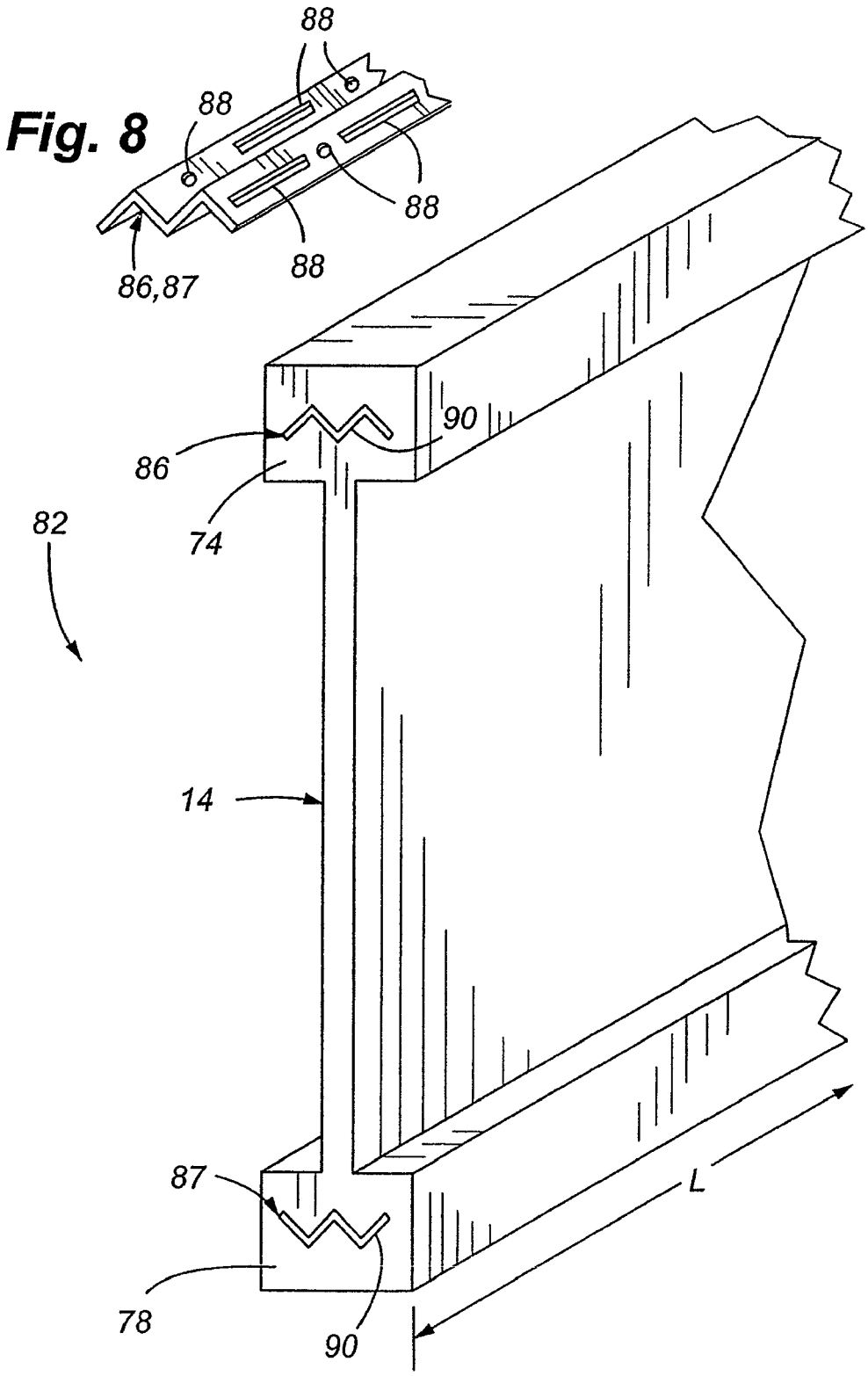
FIG. 7 is a perspective view of an I-joist in accordance with embodiments of the present invention.

Referring now to FIGS. 7-8, an I-joist structural member 82 in accordance with embodiments of the present invention is shown. I-joist 82 may be understood to add elements to the basic structure of I-joist 70, and further includes flange reinforcing members 86, 87 within flanges 74 and 78, respectively. More particularly, FIG. 8 shows an illustrative configuration which may serve for both reinforcing members 86, 87, wherein flange reinforcing members 86, 87 are positioned in or manufactured in conjunction with formation of flanges 74, 78, respectively.

The presence of flange reinforcing members 86, 87 improves the structural performance of the I-joist, and allows the I-joist to provide adequate load carrying capacity with tolerable deflection, while maintaining a relatively small profile. Preferably, the flange reinforcing members include a metal or metal alloy, as for example, an aluminum alloy, with the dimensions and thickness of the sidewalls of the flange reinforcing members being capable of being customized and selected based on intended use of the I-joist. The reinforcing members may also include carbon fiber. The use of an aluminum alloy material as compared to steel as a flange reinforcing member can enable a lighter weight I-joist and can enable the I-joist to be cut relatively easily using standard construction equipment. That is, an aluminum alloy provides attractive reinforcing characteristics, while at the same time not unduly dulling cutting blades of saws that are used to dimension to length the I-joist. Carbon fiber provides yet a lighter weight I-joist, but would potentially require the use of diamond-bit blades for successful repeated cutting and dimensioning the I-joist.

In accordance with embodiments of the present invention, flange reinforcing members 86, 87 are encased within flanges 74, 78, wherein the material forming the flange completely surrounds the longitudinal sides of the reinforcing member. Flange reinforcing members preferably extend substantially the entire longitudinal length L of the I-joist.

Flange reinforcing members may take on a variety of shapes. Referring again to FIG. 7, flange reinforcing members 86, 87 may, as by way of example and not limitation, include a plurality of angles and substantially planar surfaces, such as forming a corrugated reinforcing member 90, 91.

Corrugated reinforcing member 90, 91 may include sharper or wider angles as compared to the example structure shown in FIGS. 7 and 8, and may further include rounded corners and curved surfaces. Thus, it is to be understood that the shape of corrugated reinforcing member 90, 91 shown in FIGS. 7 and 8 and is provided by way of illustration and not limitation.

Figure 9:
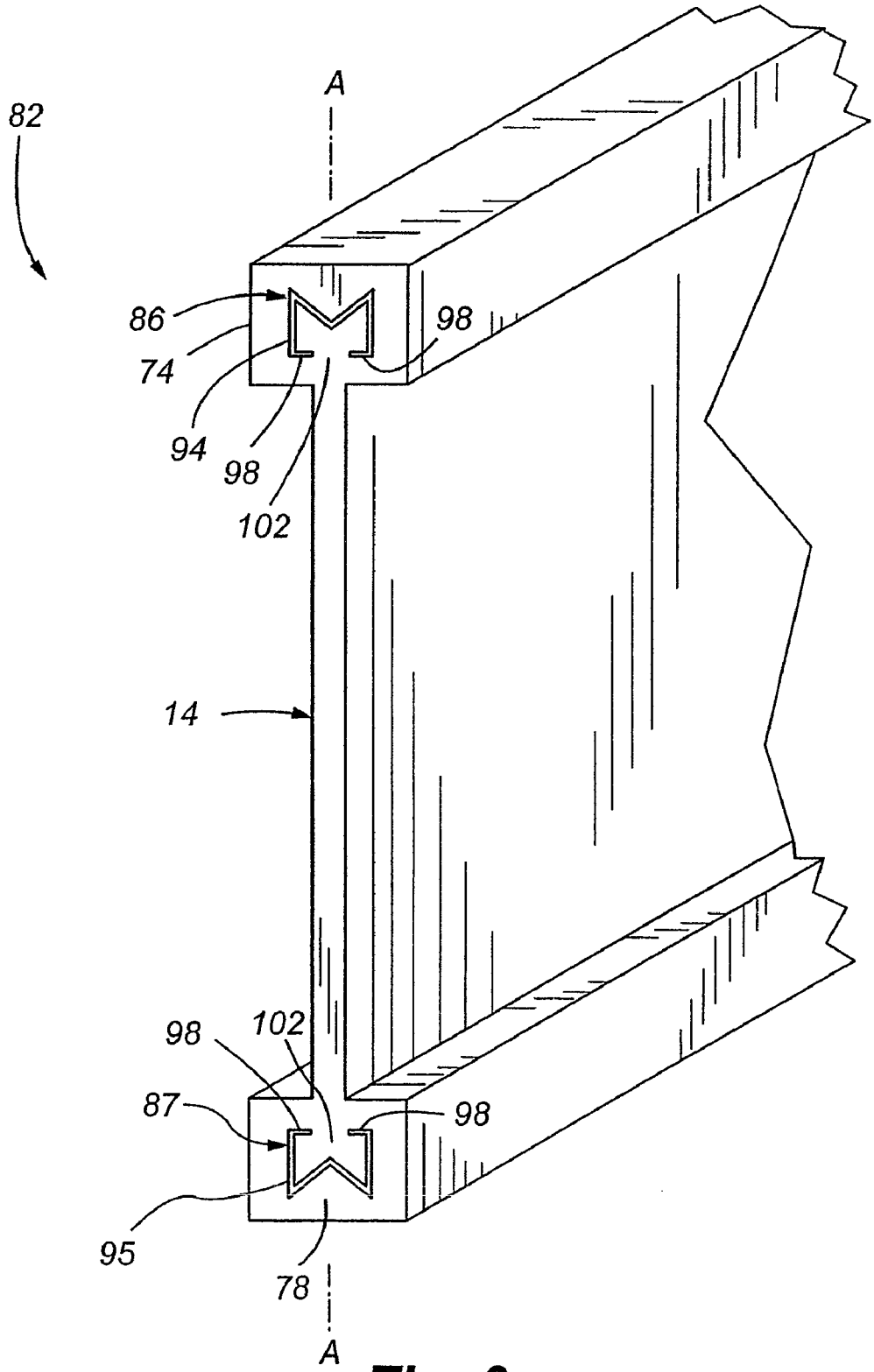

Referring now to FIG. 9, another configuration of flange reinforcing members 86, 87 is shown. The substantially M-shaped reinforcing members 94, 95 of FIG. 9 include a pair of inward projections 98 adjacent opening 102. In accordance with embodiments of the present invention, opening 102 is open toward webbing 14, and is preferably substantially aligned with axis A-A of webbing 14. When placed in lower flange 78, substantially M-shaped reinforcing member 95 is preferably inverted, as shown.

Figure 10:
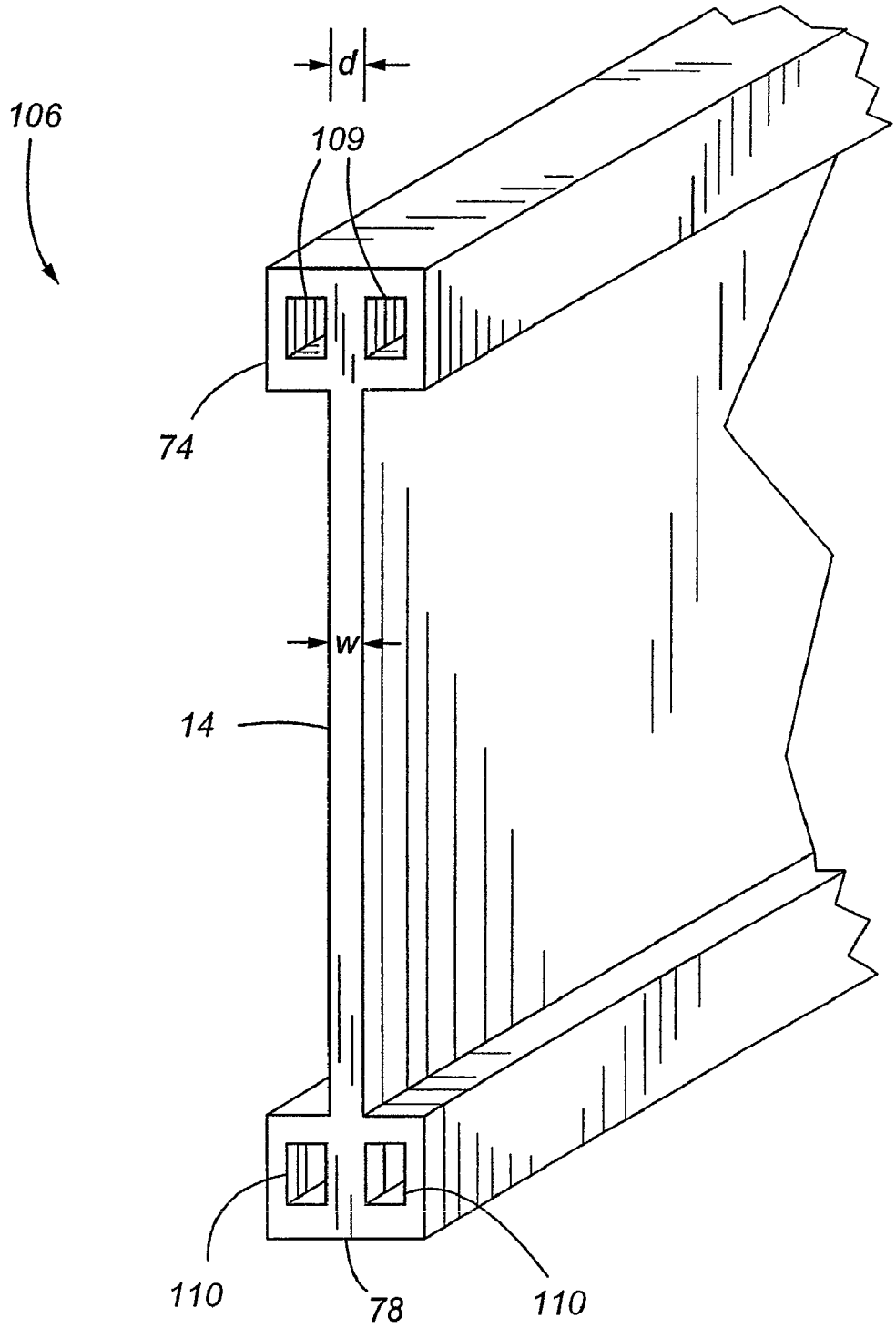

Referring now to FIG. 10, an I-joist structural member 106 in accordance with embodiments of the present invention is shown. I-joist 106 adds to the structure of I-joist 70, and further includes at least one enclosed flange reinforcing member 109, 110 within each of flanges 74 and 78, respectively.

In the illustration of FIG. 10, each of upper flange 74 and lower flange 78 includes a plurality of enclosed flange reinforcing members 109, 110 that are spaced apart from one another. However, a single enclosed flange reinforcing member 109, 110 may be used, depending upon the desired structural performance sought. Preferably, enclosed flange reinforcing member 109, 110 is hollow and includes a metal or metal alloy, as for example, an aluminum alloy, with the dimensions and thickness of the sidewalls of the enclosed flange reinforcing member capable of being customized and selected based on the intended use of the I-joist. Enclosed flange reinforcing member 109, 110 preferably extends substantially the entire longitudinal length L of the I-joist.

As shown in FIG. 10, and in accordance with embodiments of the present invention, enclosed flange reinforcing members 109, 110 include a substantially rectangular member. However, other shapes are within the scope of the present invention, which may be but are not limited to geometric shapes. By way of illustration, such other shapes may include a triangular shape or a flattened-oval shape, for example.

As shown in FIG. 10, in one aspect of the present embodiment, the pair of enclosed flange reinforcing members positioned in upper flange 74, as well as the pair in lower flange 78, are spaced apart a distance "d" that is substantially the same as width "w" of webbing 14. However, separation distance d may be less than or greater than width w of webbing 14.

In accordance with preferred embodiments of the present invention, each of the enclosed flange reinforcing members is situated within upper flange 74 or lower flange 78, wherein the material forming upper flange 74 or lower flange 78 completely surrounds the sides of each enclosed flange reinforcing members. Preferably, I-joist 106 includes an HDPE material that forms the upper and lower flanges, while the HDPE material completely surrounds each longitudinal side of the enclosed flange reinforcing members.

Figure 11B:
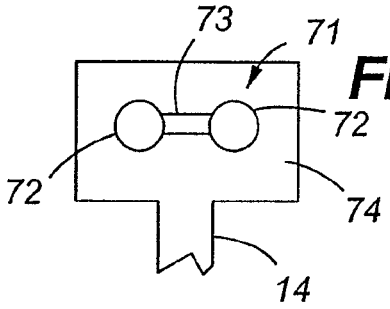
FIG. 11B is an end, side elevation view of a flange of an I-joist having an alternate embodiment of a reinforcing member.
Figure 11A:
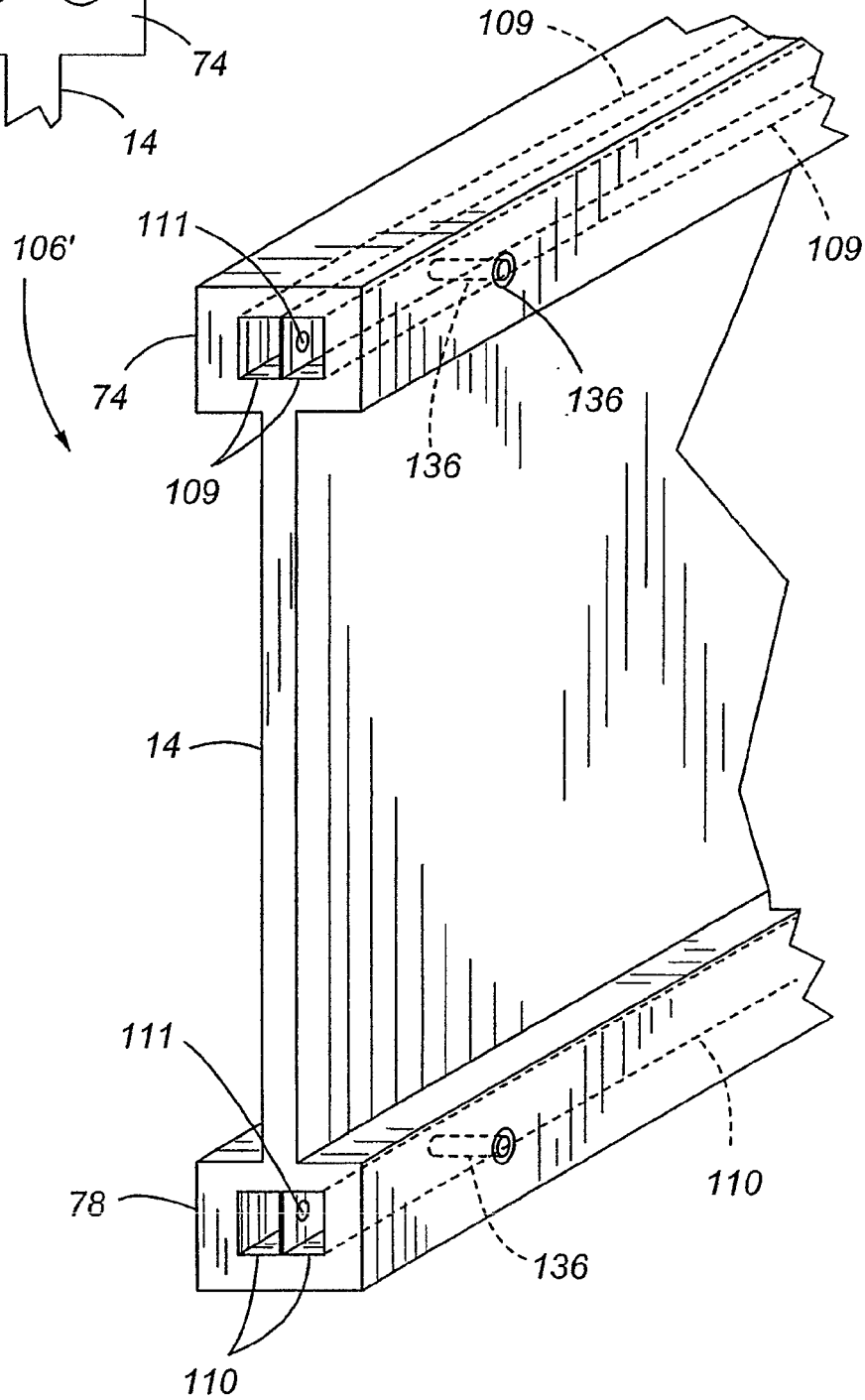

Referring now to FIG. 11A, an I-joist structural member 106' is shown, wherein two adjacent enclosed flange reinforcing members 109, 109 and 110, 110 are used in each of upper flange 74 and lower flange 78, respectively. Flange reinforcing members 109, 109 are used in an upper flange 74 and may have a selected separation distance (if any), and a like configuration may be provided for flange reinforcing members 110, 110 in lower flange 76. Although not required for all structural applications, flange reinforcing members in a particular flange may be interconnected by a tie bar, band, wire, glue, weld, pin, rivet, screw or other connecting means 111.

Referring now to FIG. 11B, in accordance with embodiments of the present invention, reinforcing member 71 is shown within upper flange 74. However, it is to be understood that reinforcing member 71 may be used in lower flange 78 of an I-joist, and may also be used in other structures, such as posts and beams. Reinforcing member 71 includes a plurality of rods 72 having a substantially circular cross section, wherein the rods 72 are rigidly connected by a cross member 73. The reinforcing member 71 is preferably formed of carbon fiber or a metal alloy, such as an aluminum alloy. Depending upon the loading conditions for the structural member, the reinforcing member may comprise solid or hollow rods 72, with a solid or hollow cross member 73.

In accordance with embodiments of the present invention, I-joists may include an upper flange having a reinforcing member, such as a corrugated reinforcing member 90, and the lower flange may having a different type of reinforcing member, such as an enclosed flange reinforcing member 110. Accordingly, it is within the scope of the present invention that the upper and lower flanges may include different types of reinforcing members. Such configurations may be advantageous for certain design considerations, such as where the upper and lower flanges will experience different amounts and/or modes of loading.

Figure 12:
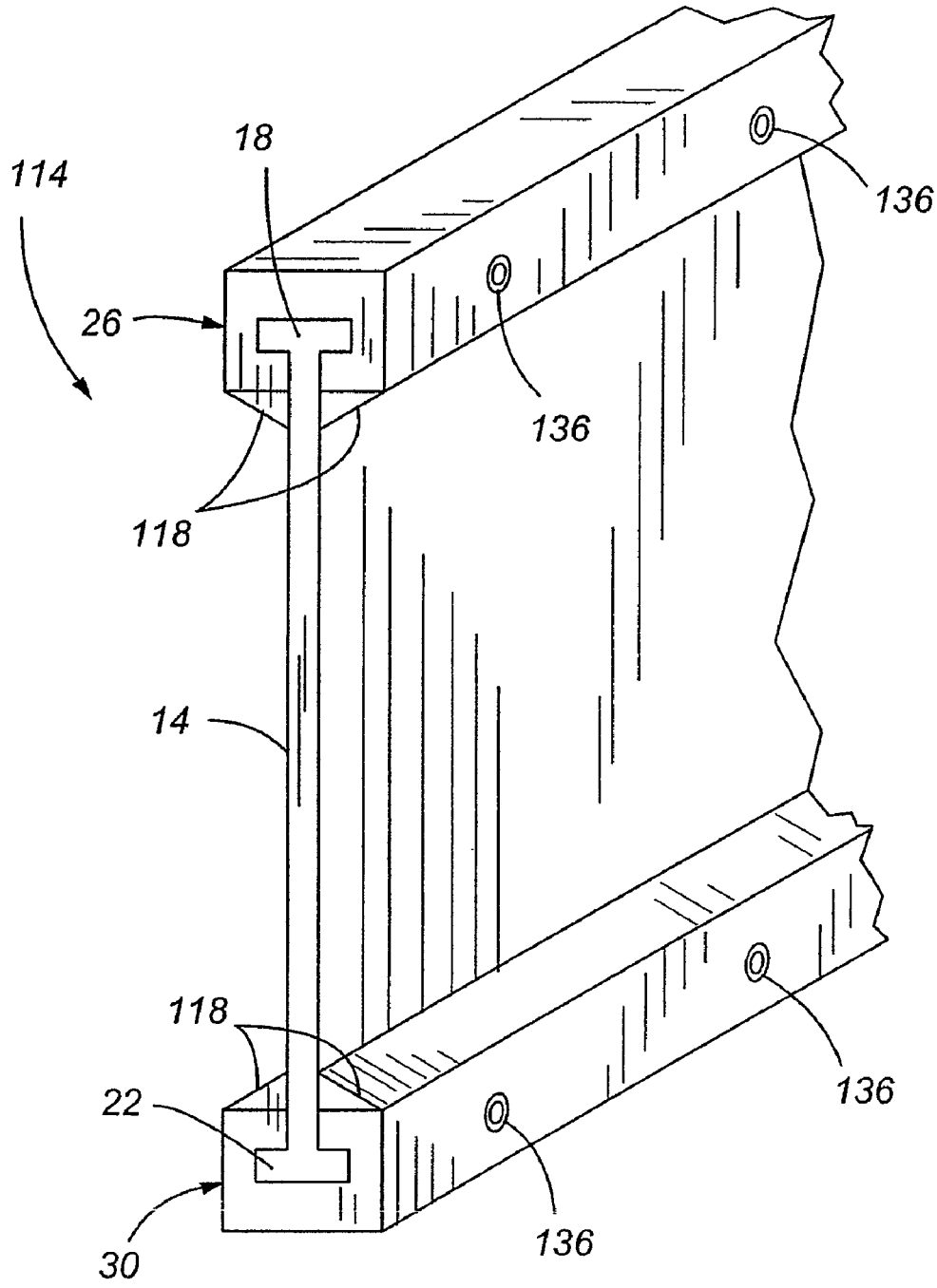
FIG. 12 is a perspective view of an I-joist having gusset reinforcing members in accordance with embodiments of the present invention.

Referring now to FIG. 12, in accordance with embodiments of the present invention, an I-joist structural member 114 is shown that includes reinforcing wedges or gussets 118 as reinforcing members between outer upper flange 26 and webbing 14. In addition, gusset reinforcing members 118 may also be used between webbing 14 and outer lower flange 30. Gusset reinforcing members 118 may be formed as part of the outer flanges.

It will be appreciated by those skilled in the art that conventional wood or composite I-joists that are constructed by gluing the top and bottom flanges to the vertical center member are not weather-resistant, unlike HDPE weather-resistant embodiments of the present invention. An additional benefit of the present invention is that the configuration can be a plain or true I-system or a custom I-system.

Such custom configuration may include strengtheners or deflection-reducing elements, such as having gussets 118 supporting webbing and/or the upper and lower flanges, or having one or more pins 136 mating the HDPE overlay and the reinforcing core, so as to further strengthen the resulting structural members.

Figure 13:
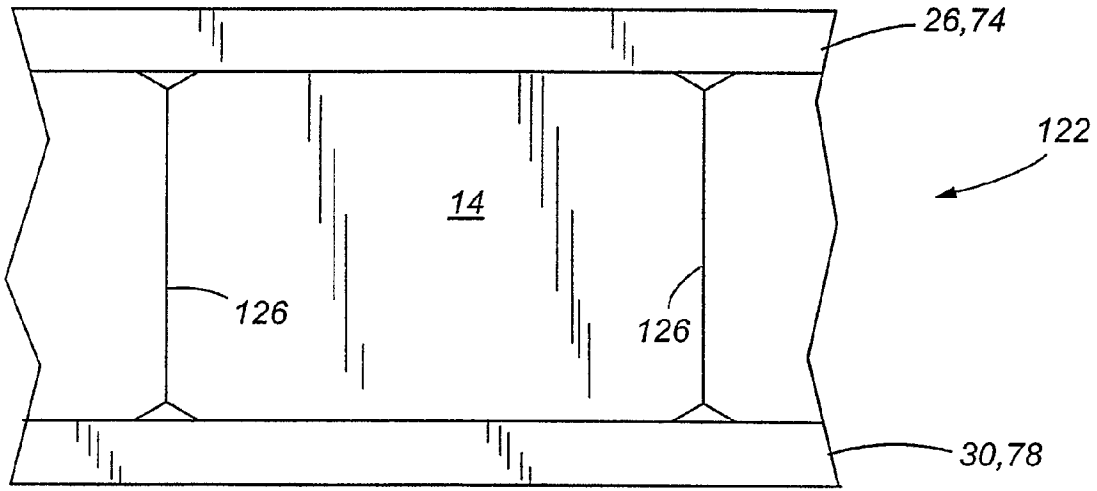
FIG. 13 is a side elevation of an I-joist having side vertical reinforcing members in accordance with embodiments of the present invention.

Referring now to FIG. 13, a partial side elevation view of an I-joist structural member 122 is shown that includes at least one, and more preferably, a plurality of vertical reinforcing members 126 positioned along the exterior of webbing 14. Vertical reinforcing members 126 increase stability, load capability and/or load transfer characteristics of I-joist. Vertical reinforcing members 126 are preferably spaced apart laterally and positioned between the bottom of outer upper flange 24 and the top of outer bottom flange 30.

Alternatively, vertical reinforcing members 126 may be positioned between the bottom of upper flange 18 and the top of lower flange 22, extending through the outer upper flange 26 and outer lower flange 30. Alternatively, for I-joists not having an outer upper flange 26 or an outer lower flange 30, vertical reinforcing members 126 may be placed between upper flange 74 and lower flange 78, as for example, in I-joists 70, 82, 106, and 106' described above.

Figure 14:
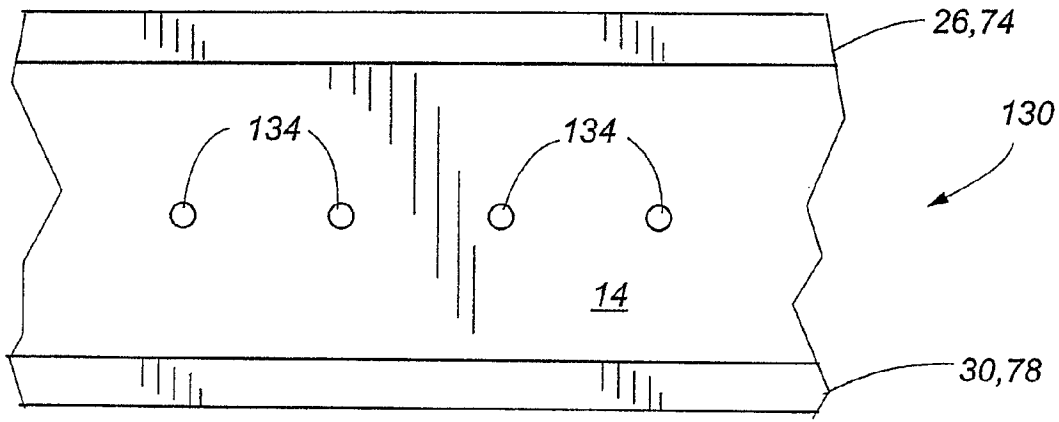
FIG. 14 is a side elevation of an I-joist having webbing with knockouts in accordance with embodiments of the present invention.

Referring now to FIG. 14, in accordance with embodiments of the present invention, an I-joist structural member 130 is shown that includes one or more knock-outs 134 in webbing 14. Such knock-outs 134 are advantageous for passing conduits through the joist framing, such as for electrical power.

Redwood and treated hemlock/fir are often used for outside decking material because of their ability to withstand weathering better than other lumber products. Load to deflection tests have been conducted using I-joists according to the invention versus wood product that would be replaced therewith. Such testing demonstrated better performance of an I-joist of the present invention as against redwood and treated hemlock/fir. Therefore it will be appreciated that the present invention provides easy to configure and weather-resistant structural members with excellent load-bearing characteristics that enables improved load-bearing systems for a wide variety of applications.

Referring now to FIGS. 15A-15G, in accordance with embodiments of the present invention, additional illustrative structural members 200 are shown by way of illustration and not by way of limitation of the invention. These members may serve as reinforcing configurations within the flanges for I-joists, beams, posts, studs, or the like in horizontal or vertical structural support systems, for a variety of purposes. An illustrative application includes structural columns and posts for supporting framing, such as to support dock or deck platforms, or such as otherwise may be used to support I-joists thereunder.

Support members 200 include a core reinforcing member surrounded by a thermoplastic material, such as HDPE. The core reinforcing members are stiff or rigid and preferably hollow, and may be formed of a metal or metal alloy, such as an aluminum alloy, or may also be formed of carbon fiber.

Figure 15A:
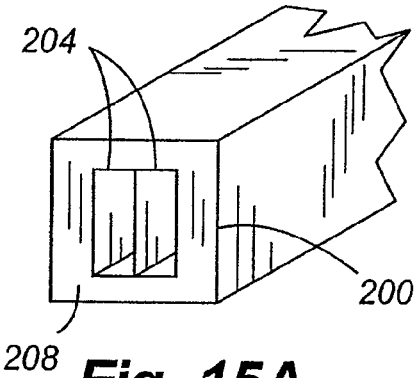
FIGS. 15A-15G are perspective views of posts (or reinforced portions of structural members) having core reinforcing members in accordance with embodiments of the present invention.

The following configurations are described with respect to cross-sectional views. Referring to FIG. 15A, a rectangular or square post 200 having a plurality of rectangular core reinforcing members 204 is shown, where members 204 are surrounded by outer layer 208 that includes HDPE.

Figure 15B:
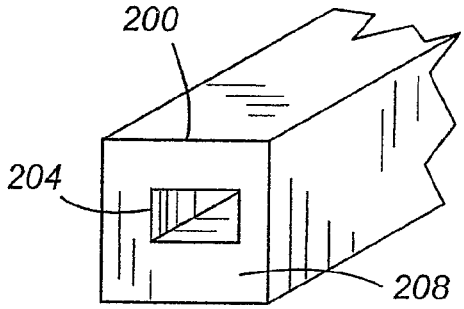
Figure 15C:
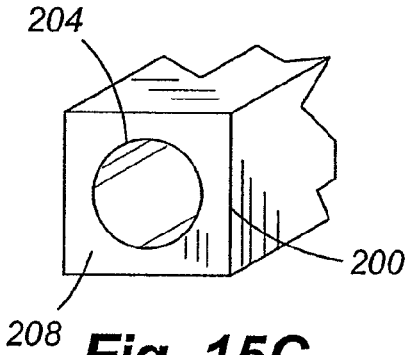

Referring to FIG. 15B, a rectangular or square post 200 is shown with a single core reinforcing member 204 having a rectangular cross section. Referring to FIG. 15C, a rectangular or square post 200 is shown with a single core reinforcing member 204 having a circular cross section.

Figure 15D:
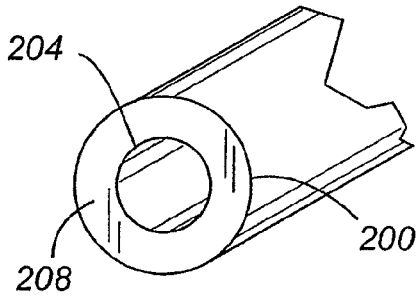
Figure 15E:
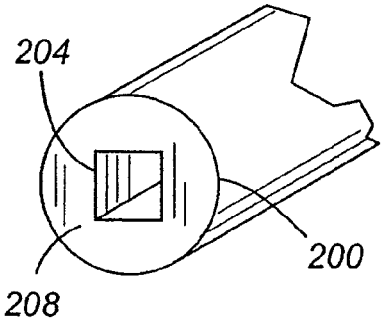

Referring to FIG. 15D, a circular post 200 is shown with a single core reinforcing member 204 having a circular cross section. Referring to FIG. 15E, a circular post 200 is shown with a single core reinforcing member 204 having a rectangular cross section.

Figure 15F:
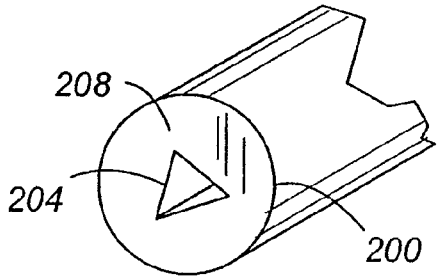
Figure 15G:
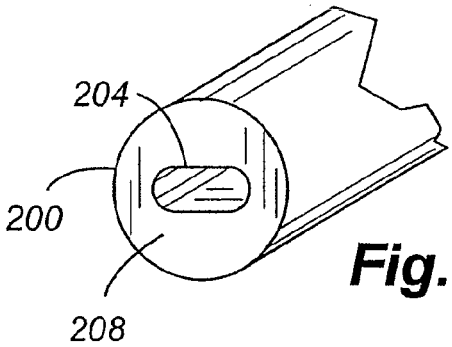

Referring to FIG. 15F, a circular post 200 is shown with a core reinforcing member 204 having a triangular cross section. Referring to FIG. 15G, a circular post 200 is shown with an core reinforcing member 204 having a flattened oval cross section. Thus a variety of post configurations are possible, as are a variety of core reinforcing members, in practice of the invention.

During manufacture of the reinforcing members, or prior or during forming an I-joist, post, or beam, the reinforcing member may be textured to provide improved adhesion between the surface of the reinforcing member and the HDPE. Surface texturing is anticipated to provide better bonding between the thermoplastic material and the reinforcing member, and thus better structural performance.

Referring again to FIGS. 7-8, flange reinforcing members 86, 87 may include one or more apertures 88. Apertures 88 also provide continuity between the thermoplastic material, as for example HDPE, located above and below the flange reinforcing members 86, 87.

It will be further appreciated that surfaces of flange reinforcing members 86, 87, enclosed flange reinforcing members 109, 110, or core reinforcing member 204, and the like, may include a textured, scarified, and/or roughed surface and which may also include projections or indentations as well as apertures 88. An example of this surface treatment is generally shown in FIG. 5 as details 66.

Figure 16:
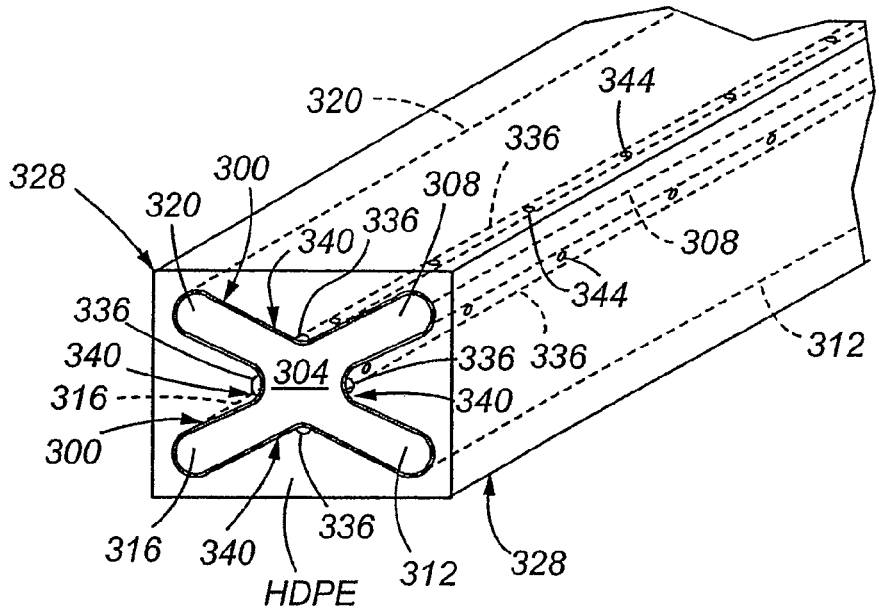
FIGS. 16-20 show illustrative reinforcement embodiments of the present invention, the reinforcing members suitable for use in the flange portion of I-joists, as well as in posts.

Referring now to FIG. 16, a structural reinforcing member 300 is provided that includes a plurality of arms extending from a central core 304. In accordance with illustrative embodiments of the present invention, structural reinforcing member 300 includes four arms, including a first arm 308, a second arm 312, a third arm 316, and a fourth arm 320. The first arm 308 is preferably situated substantially opposite third arm 316, or between about 160 to 200 degrees from third arm 316, and more preferably, about 180 degrees from third arm 316. Similarly, second arm 312 is also preferably situated substantially opposite fourth arm 320, or between about 160 to 200 degrees from fourth arm 320, and more preferably, about 180 degrees from fourth arm 320. In addition, first arm 308 is separated from second arm 312 by between about 45 to 90 degrees, and more preferably, by between about 55 to 75 degrees, and more preferably yet, by between about 68 degrees. Similarly, third arm 316 is separated from fourth arm 320 by between about 45 to 90 degrees, and more preferably, by between about 55 to 75 degrees, and more preferably yet, by between about 68 degrees. A structural reinforcing member may have more than four arms and is considered within the scope of the present invention. As for example and not intending to limit the scope of the invention, a reinforcing member may comprise six arms.

Structural reinforcing member 300 is encased within HDPE structural member 328 and preferably includes a metal alloy, such as an aluminum alloy, or carbon fiber. In accordance with several embodiments of the present invention, central core 304 is preferably hollow. Structural reinforcing member 300 preferably extends the entire longitudinal length L of structural member 328.

Figure 17:
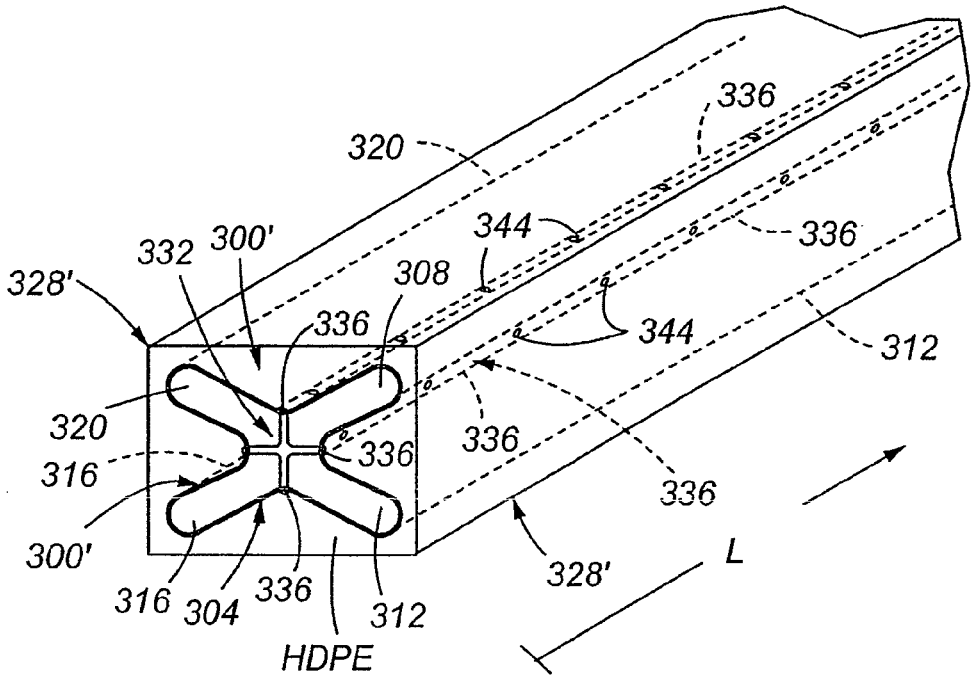

Referring now to FIG. 17, a modified structural reinforcing member 300' is shown, wherein structural reinforcing member 300' includes an internal reinforcing core 332. Reinforcing core 332 adds additional strength to structural reinforcing member 300', and allows structural member 328' including structural reinforcing member 300' to be used in higher load types of applications, but without the extra weight of a solid core addition.

As shown in FIG. 17, reinforcing core 332 appears as a cross-shaped member. However, other shaped reinforcing cores are within the scope of the present invention. As for example, reinforcing core may include a substantially square, circular or diamond shape in cross section.

Referring still to FIGS. 16 and 17, and in accordance with embodiments of the invention, the exterior surface of structural reinforcing members 300 and 300' preferably includes a surface texturing to aid in the bonding of the surrounding HDPE with members 300 and 300'. More particularly, an exterior rib 336 may be provided at the exterior intersection 340 between arms 308, 312, 316 and 320 of structural reinforcing members 300 and 300'. Ribs 336 preferably extend the longitudinal length L of structural reinforcing members 300 and 300'.

Still referring to FIGS. 16 and 17, in accordance with embodiments of the present invention, ribs 336 may further include fully penetrating or partially hollowed out depressions or divots 344. Divots 344 are preferably spaced apart along the longitudinal length of ribs 336. Divots 344 serve to further anchor reinforcing member 300, 300', that preferably includes an aluminum alloy or carbon fiber, to the surrounding thermoplastic material, preferably HDPE. Divots 344 assist in limiting or removing sliding tendencies between the HDPE and reinforcing members 300, 300' when structural members 328, 328' are under loaded conditions. In an alternative embodiment, the reinforcing member 300, 300' may include apertures 88 that act as openings for receiving at least some HDPE when the HDPE is extruded around the reinforcing member 300, 300'. As with divots 344, the apertures 88 assist in limiting or removing sliding tendencies between the HDPE and reinforcing members 300, 300' when structural members 328, 328' are under loaded conditions.

Figure 18:
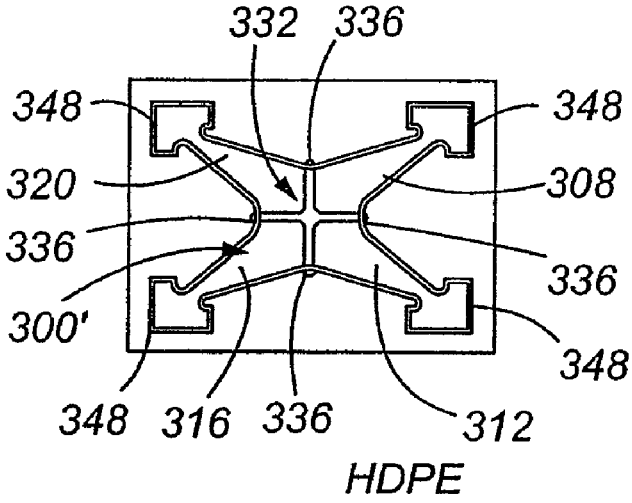
Figure 19:
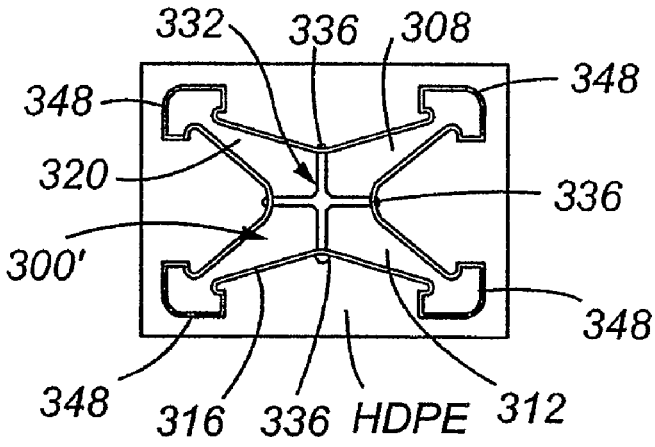
Figure 20:
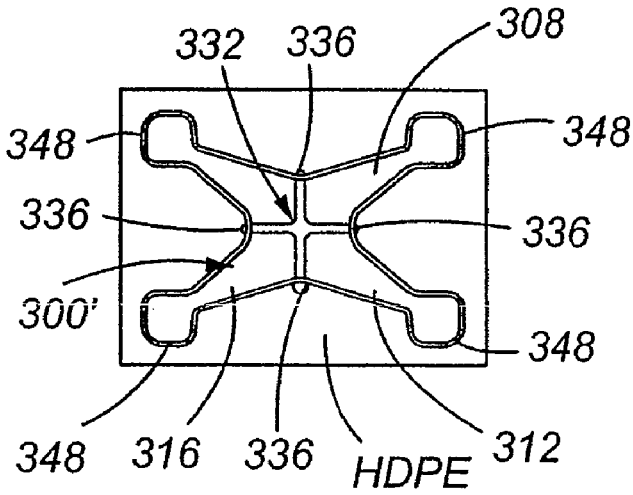

Referring now to FIGS. 18-20, end elevation views of structural reinforcing members 300' are shown, wherein arms 308, 312, 316 and 320 have various shapes and end shapes 348, such as prongs or lobes. For the reinforcing members shown in FIGS. 18-20, reinforcing cores 332 may be omitted if a hollow structural member 300 without reinforcing cores 332 is desired. Reinforcing members 300, 300' may also be solid.

Figure 21:
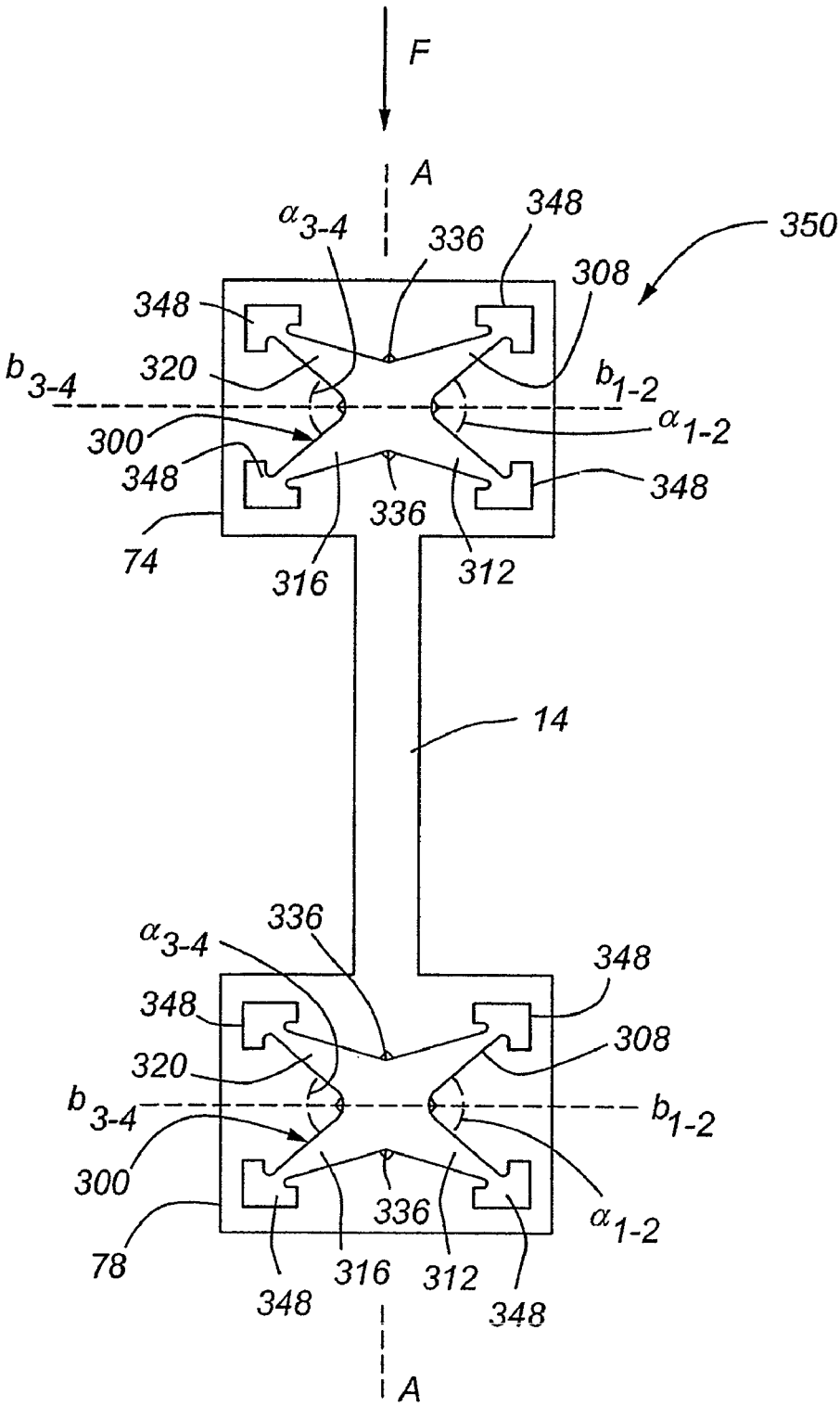
FIG. 21 is an end, side elevation view of an I-joist in accordance with embodiments of the present invention.

In practice of an embodiment of the invention, structural reinforcing members 300 and 300' may be used in I-joists, posts beams, trusses, and the like, with good benefit. As for example, FIG. 21 illustrates an embodiment of the present invention, wherein I-joist 350 includes flange 74, 78 with reinforcing members 300, 300'. In accordance with embodiments of the present invention, for I-joist 350 the reinforcing member 300, 300' is preferably oriented such that a bisector "b.sub.1-2" of the angle ".alpha..sub..1-2" between first arm 308 and second arm 312 is transverse to axis A-A of the I-joist 350, and more preferably, bisector "b.sub.1-2" is substantially perpendicular to axis A-A of I-joist 350. Similarly, bisector "b.sub.3-4" of the angle ".alpha..sub.3-4" between third arm 316 and fourth arm 320 is transverse to axis A-A of the I-joist 350, and more preferably, bisector "b.sub.3-4" is substantially perpendicular to axis A-A of I-joist 350. I-joist 350 is anticipated to preferably be oriented such that a compression load or force "F" applied to I-joist 350 is substantially parallel to axis A-A of I-joist 350.

The configuration of the reinforcing member 300, 300' comprising a plurality of arms enhances the strength of the entire I-joist 350. This is achieved under loading conditions when the upper arms 308 and 320 tend to converge toward the lower arms 312 and 316, respectively, thereby binding in place the HDPE. That is, the first arm 308 and the second arm 312 tend to converge toward each other compressing the HDPE between them together and thereby further locking the reinforcing member 300, 300' in place under loading conditions. Likewise, the fourth arm 320 and third arm 316 tend to converge toward each other compressing the HDPE between them together and thereby further locking the reinforcing member 300, 300' in place under loading conditions. In addition, the ribs 336 and associated divots 344, whether partially or fully penetrating, keep the HDPE from traversing along the longitudinal axis of the reinforcing member 300, 300' when under loading conditions.

Figure 22:
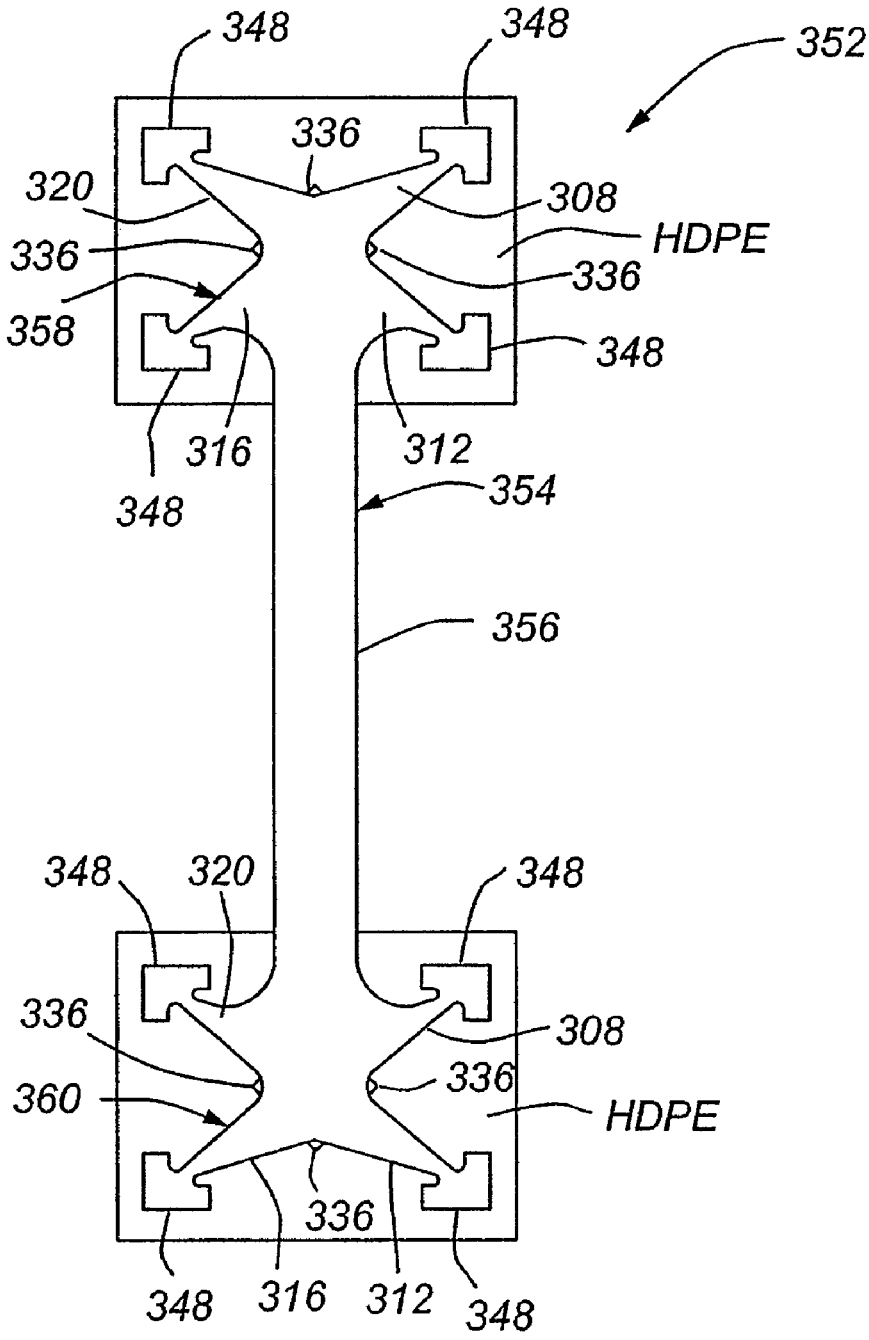
FIG. 22 is an end, side elevation view of yet another I-joist in accordance with embodiments of the present invention.

Referring now to FIG. 22, in accordance with embodiments of the present invention, an I-joist 352 is shown that comprises a web and flange reinforcing member 354. The web and flange reinforcing member 354 preferably is formed of carbon fiber or a metal alloy, such as an aluminum alloy. The web and flange reinforcing member 354 preferably comprises an assembled, integral structure that includes webbing 356 that is connected or formed integrally with reinforcing flange members 358 and 360. Webbing 356 may be solid or hollow, and reinforcing flange members 358 and 360 may comprise one of the earlier presented reinforcing members, such as reinforcing members 300, 300', where such reinforcing members may also be solid or hollow, and where hollow, may include a reinforcing core 332. In addition, the webbing 356 may be solid and combined with hollow reinforcing members. For a web and flange reinforcing member 354 made of carbon fiber, the webbing 356 is preferably thinner in width w than a structurally equivalent webbing 14 that is made of HDPE. As for example, the webbing 356 may be about 3/16 of an inch in width. In accordance with embodiments of the present invention, to form the I-joist 352, HDPE is extruded to the exterior of reinforcing flange members 358 and 360 of web and flange reinforcing member 354.

Figure 23:
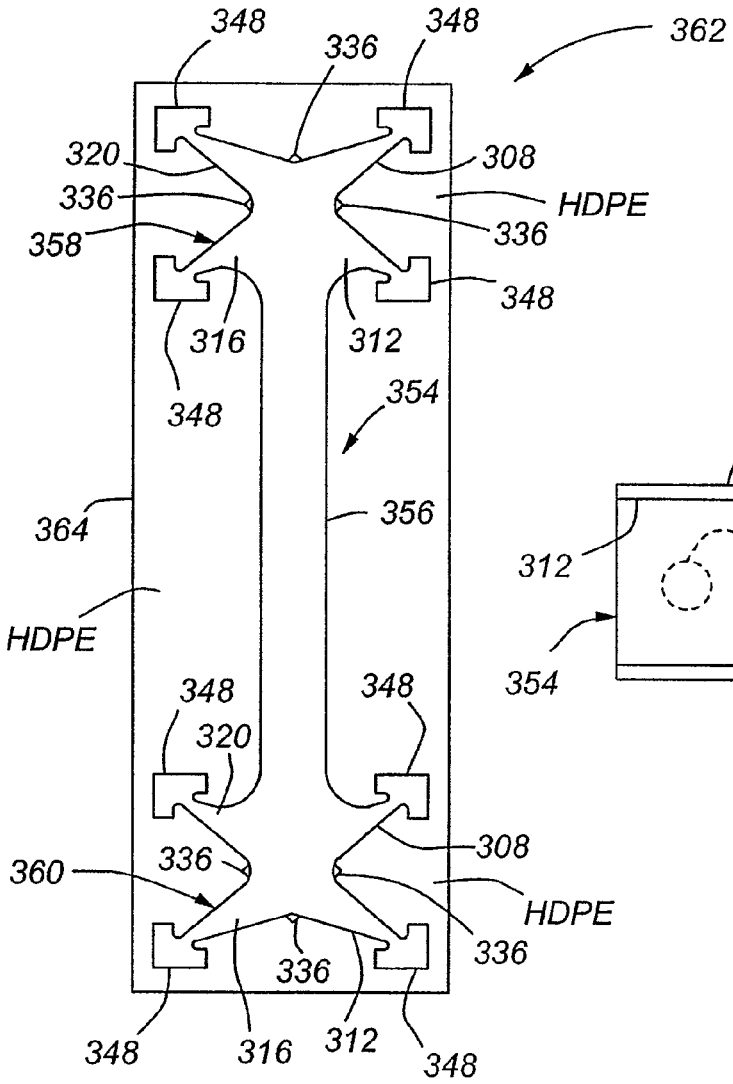
FIG. 23 is an end, side elevation view of a rim joist in accordance with embodiments of the present invention.

Referring now to FIG. 23, an end-on side elevation view of a rim joist 362 in accordance with embodiments of the present invention is shown. The rim joist 362 includes the web and flange reinforcing member 354 as described above for I-joist 352, and further comprises a substantially rectangular shaped outer member 364 encompassing the web and flange reinforcing member 354.

Figure 24:
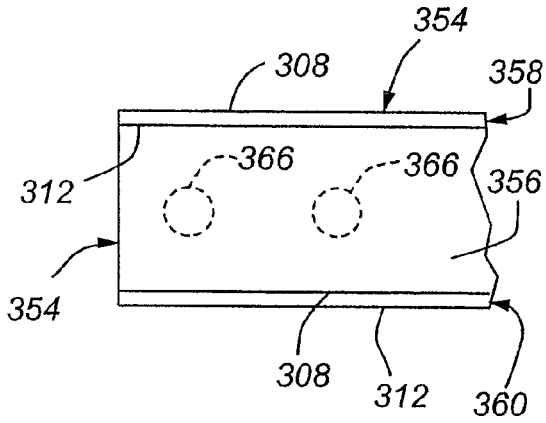
FIG. 24 is a side elevation view a web and flange reinforcing member in accordance with embodiments of the present invention.

Referring now to FIG. 24, a side elevation view of only the web and flange reinforcing member 354 is shown. In accordance with embodiments of the present invention, the web 356 of the web and flange reinforcing member 354 may include holes 366 spaced apart along its longitudinal length.

Combining HDPE with a metal alloy, such as an aluminum alloy, or carbon fiber, in the configurations shown and described herein provides functionality by increasing loading strength. Under compression or tension, the integral configuration of the structural members, flanges and the like, serves to resist movement from either, thereby improving load ratings. Hollow cores enable achieving structurally sound members with some reduction of weight.

In accordance with embodiments of the present invention, at least one method of manufacture is also provided, the method comprising a unique process. As one example, the method of manufacture may comprise a dual extrusion in-line fabrication process. It will be appreciated that the various structural assemblies are described herein which generally may be referred to as structural members or load members, and are preferably formed in a sequence of separate steps. As an illustration, for example, web member 13 and flanges 26, 30, may be formed as respective structures prior to their assembly and formation of a structural member, such as I-joist 10. Likewise, web member 13, channel reinforcing members 64, 65 and flanges 26, 30, may be formed as respective structures prior to their assembly and formation of a structural member, such as I-joist 60. As a further example, any of reinforcing members 71, 86, 87, 109, or 110 may be formed as respective structures prior to formation of a structural member 82, 106, 106', or 114. As a further example, a reinforcing member 204, 300, or 300' may be formed as respective structures prior to formation of a structural member 200, 328 or 328'.

In accordance with another embodiment of the present invention, an illustrative method of manufacturing a structural support member having a rated deflection loading includes: (a) preparing a structural reinforcing member of at least length L for bonded integration into a structural support member of at least length L; (b) forming a structural support member preform by feeding the structural reinforcing member into a thermoplastic extruder and extruding the structural reinforcing member with a thermoplastic, wherein the thermoplastic is bonded to the surface of the structural reinforcing member along the length of at least L; and (c) controlledly cooling the extrusion-formed structural support member preform wherein the thermoplastic is bonded to the structural reinforcing member along the length of at least L and wherein the bonded thermoplastic and structural reinforcing member share the loading of the structural support member without separating along the at least length L when the structural support member is loaded to the rated deflection loading.

Practice of the invention may further include preparing the structural reinforcing member, to include forming an aluminum alloy extrusion with a non-uniform surface, the surface extending a length of at least L. The method may further include forming an aluminum alloy with a non-uniform surface that includes providing surface attributes that improve the bonding of the thermoplastic (or thermoplastic composites, such as amended HDPE) to the structural reinforcing member. The method may further include preparing the structural reinforcing member to include forming an aluminum alloy extrusion with a non-uniform surface, the surface extending a length of at least L. Furthermore, the method may include preparing the structural reinforcing member to include extruding the structural reinforcing member and adjusting its temperature by cooling.

Figure 25:
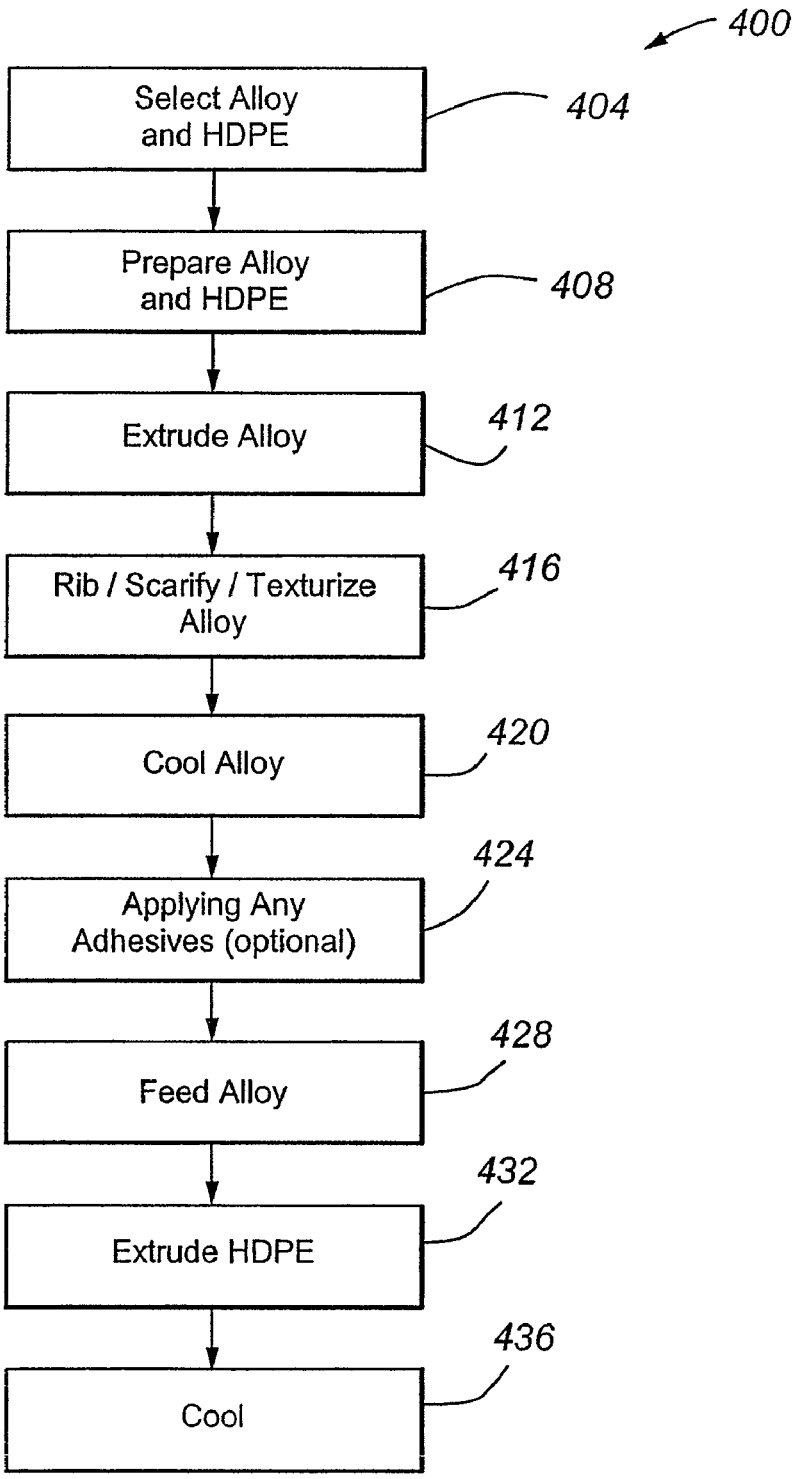
FIG. 25 shows illustrative method of the present invention.

FIG. 25 shows an illustrative method 400 for forming a structural member of the invention, including: (a) the step 404 of selecting the structural member, including selecting a thermoplastic material, and a reinforcing member shape and material type; (b) the step 408 of preparing to manufacture the structural member, including preparation of resins and reinforcing materials; (c) the step 412 of extruding the reinforcing member, such as extruding an aluminum alloy reinforcing member; (d) the step 416 of modifying, if appropriate, the reinforcing member, such as by adding partially or fully penetrating divots or apertures, scarifying at least a portion of the surface of the reinforcing member, and/or otherwise providing texturizing features to the reinforcing member that were not otherwise generated when the reinforcing member was extruded; (e) the step 420 of cooling the reinforcing member (which may occur before step (d) depending upon the materials used and the nature of the modifications performed in step 416); (f) the optional step 424 of adding any adhesives or bonding agents to at least a portion of the surface of the reinforcing member (such as may be necessary of a carbon fiber reinforcing member is used in combination with HDPE outer member); (g) the step 428 of feeding the reinforcing member, such as the aluminum alloy reinforcing member into the HDPE extruder; (h) the step 432 of extruding the HDPE around the reinforcing member; and (i) the step 436 of cooling the structural member comprising the HDPE and reinforcing member, where such cooling may be performed in a controlled fashion.

In one embodiment, at least some of steps 412 through 436 are continuous, wherein a reinforcing member is extruded to specification, cooled and texturized (if necessary), and then fed into an HDPE extruder, extruded with HDPE, and then cooled to form the desired structural member. The step 436 of cooling the extruded structural member may accommodate for complexities in cooling the extruded structural member having diverse materials, such as having a HDPE over an aluminum or carbon fiber reinforcing member. This dual in-line fabrication extrusion method has the advantage of providing all necessary opportunity for engineered control of a continuous manufacture process in one location. U.S. Patent Application Publication US 2005/0108983 A1 discloses a method of forming a reinforced extruded composite structural member, and such publication is incorporated herein by reference in its entirety.

To assist in the understanding of the present invention the following list of components and associated numbering found in the drawings is provided herein: TABLE-US-00001 Number Component 10 I-joist 13 web member 14 webbing 18 upper flange 22 lower flange 26 upper outer flange 27 upper flange assembly 29 lower flange assembly 30 lower outer flange 34 receptacle (of the upper outer flange 26) 38 key (of the webbing 14 and upper flange 18) 39 locking mechanism 42 key (of the webbing 14 and lower flange 22) 43 locking mechanism 46 receptacle (of the lower outer flange 30) 60 I-joist 64 channel reinforcing member 65 channel reinforcing member 66 details/surface texturing 68 opening 70 I-joist 71 reinforcing member 72 rods 73 cross member 74 upper flange 75 strengthening member 78 lower flange 82 I-joist 86 flange reinforcing member 87 flange reinforcing member 88 aperture 90 corrugated reinforcing member 91 corrugated reinforcing member 94 M-shaped reinforcing member 95 M-shaped reinforcing member 98 inward projections (of M-shaped reinforcing member 94) 106 I-joist 106' I-joist 109 enclosed flange reinforcing member 110 enclosed flange reinforcing member 111 connecting means 114 I-joist 118 gusset reinforcing member 122 I-joist 126 vertical reinforcing member 130 I-joist 134 knock-outs 136 pins 200 structural member (or post) 204 core reinforcing member (of post 200) 208 outer layer (of post 200) 300 structural reinforcing member 300' structural reinforcing member 304 central region (of structural reinforcing member 300 or 300') 308 first arm (of structural reinforcing member 300 or 300') 312 second arm (of structural reinforcing member 300 or 300') 316 third arm (of structural reinforcing member 300 or 300') 320 fourth arm (of structural reinforcing member 300 or 300') 328 structural member (with structural reinforcing member 300) 328' structural member (with structural reinforcing member 300') 332 reinforcing core (of structural reinforcing member 300') 336 rib (of structural reinforcing member 300 or 300') 340 exterior intersection (between the arms 308, 312, 316, 320) 344 divot 348 end shape (of arms 308, 312, 316, 320) 350 I-joist 352 I-joist 354 web and flange reinforcing member 356 webbing 358 reinforcing flange member 360 reinforcing flange member 362 rim joist 364 outer member 366 holes 400 method of manufacturing 404 select (reinforcing member specifics and outer material specifics) 408 prepare (reinforcing member and outer HDPE) 412 extruding alloy (or other reinforcing member) 416 rib/scarify/texturize alloy (or other reinforcing member) 420 cool alloy (or other reinforcing member) 424 apply adhesive (optional depending upon material type of reinforcing member) 428 feed alloy (or other reinforcing member) 432 extrude HDPE around alloy (or other reinforcing member) 436 cool HDPE A-A axis (of webbing 14 or joist) .alpha..sub.1-2 angle between first arm 308 and second arm 312 .alpha..sub.3-4 angle between third arm 316 and fourth arm 320 b.sub.1-2 bisector of the angle .alpha..sub.1-2 b.sub.3-4 bisector of the angle .alpha..sub.3-4 F force L longitudinal length d separation distance (between reinforcing members) w width (of webbing 14).

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g., for improving performance, achieving ease and\or reducing cost of implementation.

The foregoing discussion of the invention has been presented for purposes of illustration and description. The foregoing is not intended to limit Invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover, though the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of forming a lightweight structural building element for use in supporting loads comprising:

forming an aluminum alloy inner structural core constructed from a substantially solid aluminum alloy billet that is shaped to have a hollow inner space;

forming a plurality of substantially continuous hollow arms from said substantially solid aluminum alloy billet that extend outwardly from a central portion of said aluminum alloy inner structural core, said central portion extending in a longitudinal direction along a length of said aluminum allow inner structural core;

forming lobes at end portions of said substantially continuous hollow arms to enclose areas between said lobes;

extruding a thermoplastic layer over said aluminum alloy inner structural core, said plurality of substantially continuous hollow arms and said lobes so that said thermoplastic substantially surrounds exterior surfaces of said aluminum alloy inner structural core, said plurality of substantially continuous hollow arms and said lobes, said thermoplastic layer filling said areas enclosed between said lobes so that said lobes mechanically capture and partially enclose a portion of said thermoplastic layer to secure said thermoplastic layer to said aluminum alloy inner structural core and said plurality of substantially continuous hollow arms to provide a protective layer for said aluminum alloy structural core, said substantially continuous hollow arms and said lobes.

2. The method of claim 1 further comprising:

forming divots in at least a portion of said exterior surfaces of said aluminum alloy inner structural core and said plurality of substantially continuous hollow arms that further assist in mechanically securing said thermoplastic layer to said aluminum alloy inner structural core and said plurality of substantially continuous hollow arms.

3. The method of claim 1 further comprising:

forming apertures in at least a portion of said exterior surfaces of said aluminum alloy inner structural core and said plurality of substantially continuous hollow arms that further assist in mechanically securing said thermoplastic layer to said aluminum alloy inner structural core and said plurality of substantially continuous hollow arms.

4. The method of claim 1 further comprising:

scarifying at least a portion of said exterior surfaces of said aluminum alloy inner structural core and said plurality of substantially continuous hollow arms that further assist in mechanically securing said thermoplastic layer to said aluminum alloy inner structural core and said plurality of substantially continuous hollow arms.

5. The method of claim 1 wherein said process of forming said lobes further comprises:

forming said lobes into prongs that have hooks that extend in a direction towards adjacent arms to capture said portion of said thermoplastic.

6. The method of claim 1 wherein said process of foiming said plurality of continuous hollow arms further comprises:

forming said continuous hollow arms so that adjacent arms of said continuous hollow arms converge during loading of said structural building element to assist in mechanically securing said thermoplastic to said continuous hollow arms.

7. The method of claim 1 wherein said process of extruding said thermoplastic layer further comprises:

extruding said thermoplastic layer so that said thermoplastic has an outer surface that has a polygonal shape.

8. The method of claim 7 wherein said polygonal shape is substantially square.

9. The method of claim 7 wherein said polygonal shape is substantially rectangular.

10. The method of claim 1 wherein said process of extruding a thermoplastic layer further comprises:

extruding said thermoplastic layer so that said thermoplastic layer has an outer surface that is substantially round.

* * * * *